US006029851A

United States Patent [19]

Jenkins et al.

[11] Patent Number: 6,029,851

[45] **Date of Patent: *Feb. 29, 2000**

[54] APPARATUS FOR STORING AND DISPENSING ARTICLES

[75] Inventors: Alan Ernest Jenkins, Peorcedale; Siegmund Grondman, Upwey; Gower Smith, Kirribilli, all of Australia

[73] Assignee: Imaging Technologies Pty Limited, East Balwyn Victoria, Australia

[ * ] Notice: This patent issued on a continued prosecution application filed under 37 CFR 1.53(d), and is subject to the twenty year patent term provisions of 35 U.S.C. 154(a)(2).

[21] Appl. No.: 08/387,715

[22] PCT Filed: Aug. 13, 1993

[86] PCT No.: PCT/AU93/00416

§ 371 Date: Jun. 1, 1995

§ 102(e) Date: Jun. 1, 1995

[87] PCT Pub. No.: WO94/04446

PCT Pub. Date: Mar. 3, 1994

[30] Foreign Application Priority Data

| | | | |
|---|---|---|---|
| Aug. 14, 1992 | [AU] | Australia | PL 4129 |
| Nov. 13, 1992 | [AU] | Australia | PL 5839 |

[51] Int. Cl.[7] ..... A47F 1/00

[52] U.S. Cl. ..... 221/102; 364/479.01

[58] Field of Search ..... 221/92, 97, 98, 221/102, 2, 3, 7, 15, 194, 196, 224, 256; 364/479, 479.01

[56] References Cited

U.S. PATENT DOCUMENTS

| | | | |
|---|---|---|---|
| 2,971,675 | 2/1961 | Allegri | 221/97 |
| 4,803,348 | 2/1989 | Lohrey et al. | 235/381 |
| 4,866,661 | 9/1989 | de Prins | 364/900 |
| 5,028,766 | 7/1991 | Shah | 235/381 |
| 5,205,436 | 4/1993 | Savage | 221/7 |
| 5,377,864 | 1/1995 | Blechl et la. | 221/102 |

FOREIGN PATENT DOCUMENTS

| | | |
|---|---|---|
| 0 234 833 A2 | 9/1987 | European Pat. Off. . |
| 0 391 059 A1 | 10/1990 | European Pat. Off. . |
| 0 458 366 A2 | 11/1991 | European Pat. Off. . |
| 0 543 763 A1 | 5/1993 | European Pat. Off. . |
| 3418-830-A1 | 11/1985 | Germany . |
| 3636-310-A1 | 4/1988 | Germany . |
| 3636310 | 4/1988 | Germany . |
| 3908-186-A1 | 3/1990 | Germany . |
| 3917-874-C1 | 7/1990 | Germany . |
| WO 85/03790 | 8/1985 | WIPO . |
| WO 89/09982 | 10/1989 | WIPO . |
| WO 92/03360 | 3/1992 | WIPO . |

OTHER PUBLICATIONS

Supplementary European Search Report, dated Jun. 2, 1997, Appl. No. EP 93 91 7453.

*Primary Examiner*—Kenneth Noland

*Attorney, Agent, or Firm*—Marshall, O'Toole, Gerstein, Murray & Borun

[57] ABSTRACT

The present invention relates to a method and apparatus adapted to promote the recycling of complex articles, such as, in particular, printer cartridges, toner cartridges and other complex office items. The invention provides an apparatus having storage space arranged to store a number of such complex articles for recycling. Access to the storage space is controlled by a data processor which interacts with a user by way of a visual display unit and control panel. If the user wishes to store an item, he indicates this by way of the control panel and the apparatus is then operable to open a receptacle to receive the used item. When the used item is placed in the receptacle, in preferred embodiments means are provided to determine that the used item is an article of an appropriate type to be stored. These means preferably employ shape recognition. The article will be rejected if it is not of the correct type and accepted and retained in a storage space if it is of the correct type. The preferred apparatus is also arranged to dispense items on request by the user. A preferred feature is that the apparatus will not dispense a new or recycled item if a predetermined ratio of new items dispensed to used items stored by that user would be exceeded. This encourages recycling.

18 Claims, 23 Drawing Sheets

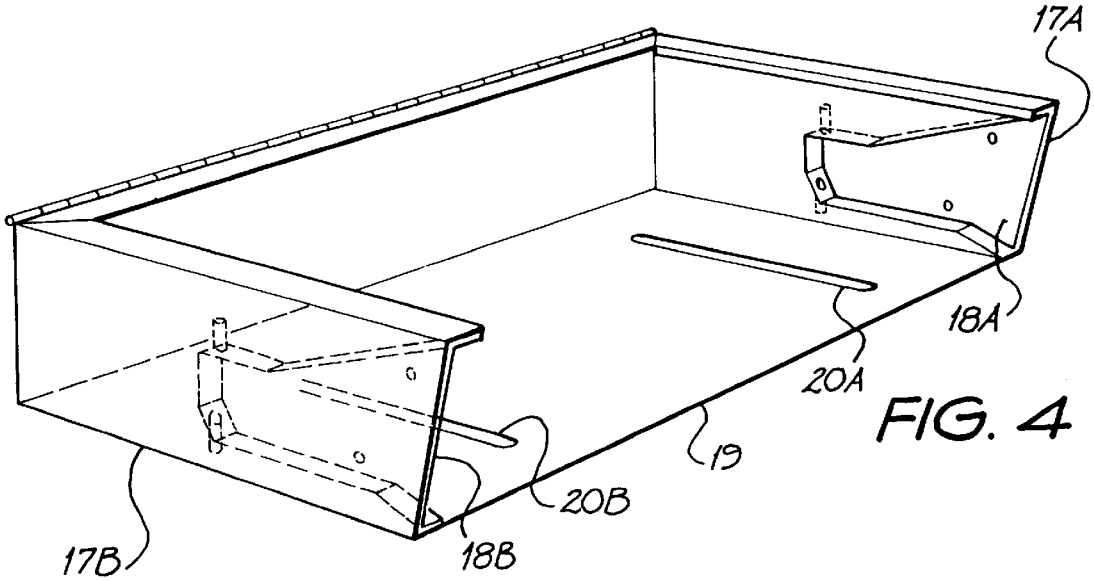
FIG. 4
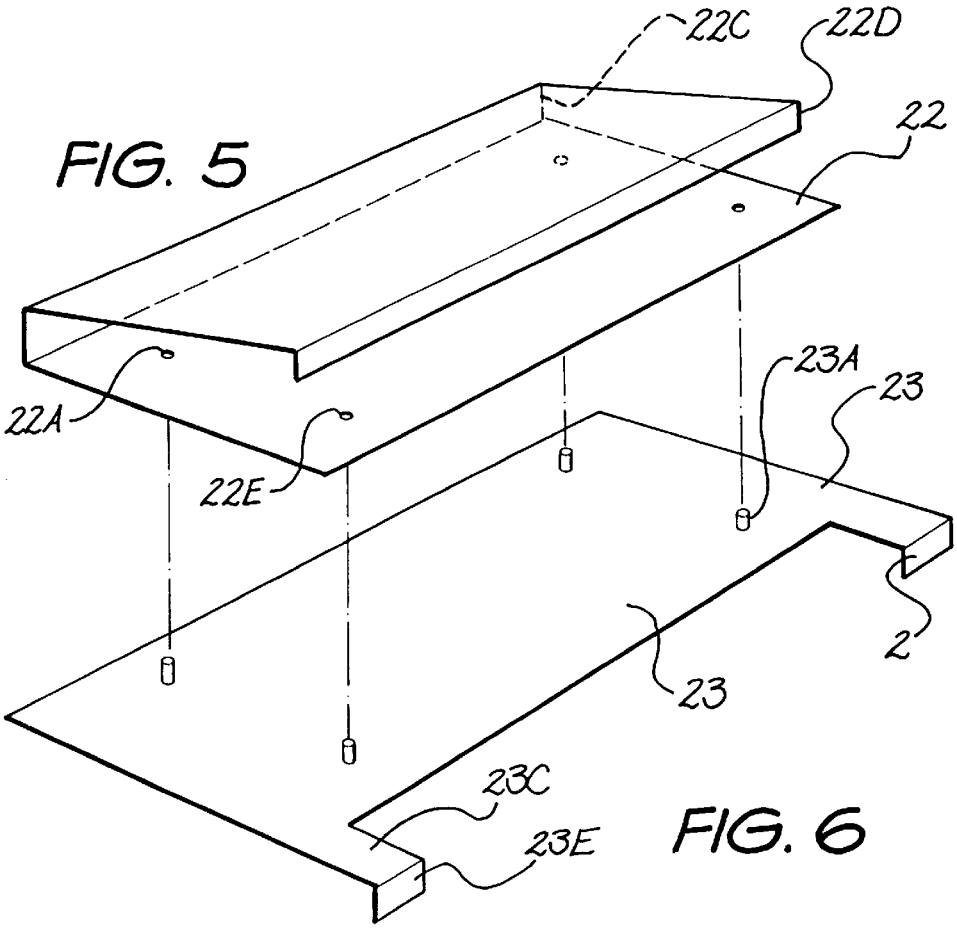
FIG. 5
FIG. 6

APPARATUS FOR STORING AND DISPENSING ARTICLES

The present invention is particularly relevant to articles which are recyclable. Typically, recycling is restricted to articles of limited complexity and value which require minimum care in handling. For example, aluminium cans and bottles can be separated from other articles in a domestic situation and can then be either delivered to a recycling location or can be collected by a recycling organisation.

In instances where more fragile and sophisticated articles are to be recycled, such as toner cartridges and printer cartridges, for example, at present there is no real alternative to storing the used articles in boxes and delivering the used articles to a recycling centre.

The present invention provides an apparatus for storing used articles and dispensing new articles, comprising storage space for storing used and new articles, detection means for detecting the storage of a used article, dispensing means for dispensing a new article, and control means for monitoring the storage of used articles and for controlling the dispensing of new articles.

Preferably, the apparatus is adapted to store and dispense "complex" articles. This includes more sophisticated articles than the type which are commonly recycled (cans, bottles, paper, etc). In particular, these articles include toner cartridges, copier toner cartridges, bubblejet cartridges, inkjet cartridges, printer ribbons and other recyclable office materials of a complex nature. The apparatus may be regularly serviced to remove used articles for recycling and to restock the apparatus with recycled articles ("new articles") for dispensing.

The apparatus is preferably established in a convenient location, such as a retail shop, a foyer of an office building, or, in a large office, in the office itself. Apparatus with different configurations may be provided depending on the type and volume of recyclable materials they are intended to handle.

Preferably, in order to encourage recycling of used articles, the dispensing of a new article is tied to the deposit of a used article, such that the apparatus will not dispense a new article if that will result in a pre-determined ratio between new articles dispensed and used articles deposited being exceeded. The ratio may be 1:1, for example, so that in order to obtain a new article a user must first deposit a used article in the apparatus. The ratio is not limited to 1:1, however, and may be of any other ratio. For example, the ratio may be three dispensed articles to one deposited article, ie a fourth new article will not be dispensed until a further used article is deposited, if only one used article has been deposited previously.

The apparatus may be arranged to serve the needs of a number of different users and identification means, such as a magnetic stripe card and associated reader may be provided to identify a user requiring a transaction. A pin number entered on a keypad may also be used for identification. In such a case, the ratio between articles dispensed and articles used may be user specific and will relate to the number of articles dispensed and the number of articles deposited by that user (or user's company).

The control means preferably includes a memory for recording each transaction by each user. This memory can be used for audit purposes, for example. The user may obtain a "credit" for every used article he deposits and a "debit" for every new article he withdraws.

The detection means preferably comprises means for determining whether an article proposed to be stored by a user of the apparatus is of an approved type to be stored. This means comprises a means for assessing pre-determined features of the article in order to identify it. The pre-determined features may be features of the shape of the article. For complex items, such as printer cartridges and the like, the shape is often distinctive. Preferably, the means for assessing the shape may comprise a physical receptacle which accurately reflects the shape of at least a portion of the article. In the case of printer cartridges and the like, the physical receptacle may comprise a "drawer" or compartment having an insert therein which fits to the shape of the article together with an actuation means (such as a solenoid) which will not be actuated unless the article fits correctly into the insert. An alternative is to have a drawer or compartment with slots at the sides of the drawer corresponding to the shape of the ends of the article, so that the article will not fit into the drawer unless its ends are of the correct shape.

An alternative to assessing shape would be to use optical sensors or sensors of some other type. Other sensors may also be employed supplementary to shape detection.

The control means is preferably responsive to the means for assessing ("determining means") to disallow the dispensing of a new article and/or to produce an alarm condition, when the determining means has determined that the proposed article is not of the type which is to be stored in the apparatus. For example, if the article which should be stored is a printer cartridge, and the article is not of the correct printer cartridge shape to fit into a physical receptacle of the apparatus which accepts the article for storing, then the article may be rejected and any subsequent transaction by the same user to request dispensing of a new article may be denied. Further, an alarm condition of the machine may be activated to indicate that improper use of the apparatus is being attempted. When the apparatus is connected by communication means to a master controller (see later) the indication of an alarm condition may be made at the master controller. This feature advantageously prevents improper use of the apparatus.

The storage space may comprise a plurality of separate storage receptacles, preferably one storage receptacle for each article stored. In one embodiment, each storage space is separately accessible and comprises a compartment with a lockable door, the door being controlled by the control means. On indication to the control means by a user that the user wishes to store an article, a door to a compartment will be opened and the user will be required to place the article into the compartment and close the door. Subsequently, if the user desires a new article, the door to a compartment containing a new article will be opened and the user may take the article. A memory in the control means will record the transaction against the particular user.

In other embodiments, a reception receptacle is provided in which to place a used article. The reception receptacle includes the detection means and the determining means for the article. The receptacle communicates with a chute to allow the used article to fall through to a storage bin or is connected to separately accessible storage spaces by means of transport mechanism for transporting of the used article to the storage space. The reception means may also be used as a dispensing means in such an embodiment, the transport means being controllable under controlled means to remove an article from a storage space and convey it to the reception means. Alternatively, a separate dispensing outlet may be provided, which is enabled by the control means, and that is connected to a "stack" of new articles, for example. The dispensing means may be at the bottom of the stack so that each time a new article is removed, an article drops from the stack to take its place for removal in a subsequent transaction.

Preferably, the apparatus in accordance with the present invention is adapted to be serviced by an organisation, department or entity separate from the actual users of the apparatus. For example, the apparatus may be serviced on the basis of a similar system to that used for photocopying machines nowadays. That is, when servicing is required, an external servicing agent is called in. In the present case, it is preferred that the apparatus is connected to a master controller at a remote servicing centre, by means of a communication link, such as a telephone data link. The control means is preferably arranged to monitor machine status including remaining capacity, number of used articles stored and number of replacement articles dispensed. Where the number of used articles reaches a pre-determined number and/or the number of new articles drops below a pre-determined number, the control means will communicate this to the master control means which will indicate that servicing of the apparatus is required. A service agent can then be sent down to re-stock the apparatus and/or remove used articles for recycling. If the apparatus breaks down, a similar procedure may be followed, the master control means being informed that the apparatus is inoperable or partially inoperable and causing a service agent to be sent out to the apparatus. The master control means may access a plurality of apparatus to which it is connected on a polling basis, for example.

The present invention further provides a system for monitoring and controlling the storage of used articles and the dispensing of new articles, comprising an apparatus in accordance with any or all of the features of the apparatus discussed in the preceding paragraphs and a master control means, the master control means being connected to monitor the operation of the apparatus to determine when the number of used articles has reached a pre-determined number such that the apparatus requires servicing to remove used articles, and to determine when the number of new articles has been reduced to a pre-determined number such- that the apparatus requires servicing to be replenished with new articles.

The present invention yet further provides a method of recycling complex articles, comprising the steps of providing an apparatus in accordance with any of the preceding paragraphs monitoring the apparatus to determine when an apparatus contains a pre-determined number of used articles, collecting the used articles for recycling, and optionally replacing recycled articles in an apparatus to be dispensed as new articles. The apparatus may be used as a collection only system providing a means for users to lodge recyclable materials for storage without the need to dispense replace items.

The present invention yet further provides, in an automated storage and dispensing apparatus, a method of storing used complex articles for recycling and dispensing recycled complex articles, comprising the steps of, on actuation of a control means by a user to indicate that a used article is to be stored, enabling a reception means for receipt of the used article, assessing pre-determined parameters of the used article by means of sensors and/or mechanical means to determine whether the used article is of an allowable type to be stored, and storing the used article in a storage space if it is of an allowable type to be stored; the further steps of, on actuation of the control means by a user to indicate that the user requires a recycled article, determining the ratio of used articles stored by the user to recycled articles dispensed to the user and, if the ratio does not exceed a pre-determined limit, dispensing a recycled article to the user.

The automated storage and dispensing apparatus used with the method of this aspect of the present invention may be the apparatus discussed in any of the preceding paragraphs.

The present invention yet further provides an apparatus for storing used articles and dispensing new articles, comprising a receptacle for receipt of an article, sensing means for sensing when the article is received in the receptacle, a storage assembly having a plurality of storage locations for articles, a transfer means, operable to transfer an article from a receptacle loading position to one of a plurality of storage positions for storage in an adjacent storage location and operable to transfer an article dispensed from one storage location to a storage position from that storage position to the receptacle position, a receiving/dispensing means for moving the article between a storage position and a storage location and for moving the article between the receptacle location and the receptacle, and a control means for controlling operation of the transfer means and receiving/dispensing means.

Preferably the receiving/dispensing means comprises separate devices for moving the article between the storage position and storage location, and between the receptacle location and receptacle.

The present invention yet further provides an apparatus for storing used articles and dispensing new articles, comprising:

a receptacle for receipt of used articles;

sensing means for sensing when the article is received in the receptacle;

a storage assembly having a plurality of storage locations for articles; and a transfer means for moving an article between a receptacle position and one of a plurality of storage positions, wherein each storage position is adjacent a respective one of the storage locations, whereby an article can be moved between the transfer means and one of the storage locations and can be moved between the receptacle, when the receptacle is in a transfer position and the transfer means, when the transfer means is in a receptacle position.

The apparatus preferably enables movement of a new article from one storage location to the transfer means and a used article from the transfer means to one of the storage locations.

Preferably in a receiving mode of operation, a used article is received in the receptacle, moved from the receptacle to the transfer means when located in the receptacle loading position, moved by the transfer means to one storage position and then from the transfer means to one of the storage locations.

In a dispensing mode of operation it is preferred that a new article is moved from one storage location to the transfer means when located in an adjacent storage position, by the transfer means is moved to the receptacle position and is then moved from the receptacle position to the receptacle which is arranged to dispense the new article.

The apparatus may comprise a control means for approving a used article inserted into the receiving means.

The control means may be arranged to place the apparatus in a dispensing mode of operation when a dispensing switch is activated.

The control means is preferably arranged to operate the receiving means when the sensing means senses a used article is received in the receptacle.

The apparatus may comprise sensors for indicating the position of the receptacle, and the position of the transfer means.

The apparatus may comprise sensors for indicating whether a particular storage location is occupied or vacant.

Preferably the control means is arranged to process data received from each sensor.

The control means may be arranged to control operation of the receptacle and transfer means responsive to data received from each sensor.

Preferably the apparatus comprises a receptacle on/off loader for moving an article between the receptacle and transfer means when the receptacle is in a transfer position and the transfer means is in a receptacle position.

The apparatus may comprise a storage on/off loader for moving an article between one of the storage locations and the transfer means when it is in an adjacent storage position.

Preferably the transfer means comprises a guide for guiding the article between the on-loading position and one of the off-loading positions.

The transfer means may comprise a carriage for an article.

The transfer means may comprise a guide for guiding the carriage.

The guide preferably is for guiding the carriage along a rectilinear path.

Preferably the transfer means is operable within a distribution compartment.

Preferably the distribution compartment is removably attachable to the storage assembly.

The transfer means may be an on-loading means and an off-loading means.

The off-loading means and on-loading means preferably are a combined unit.

It is preferred that the transfer means comprises a support which is operable to move an article laterally with respect to the rectilinear path.

The carriage may comprise a movable support for supporting an article. The support may be movable to the receptacle to receive an article.

The support is preferably moveable to push an article from the carriage into one of the empty storage locations when the carriage is in the off-loading position.

The carriage may comprise a driving means for moving the support.

It is preferred that the transfer means comprises guides which are arranged in parallel on opposite sides of the carriage.

The guides may be rods.

Preferably the storage locations are arranged as a series of parallel compartments.

Each of the parallel compartments are preferably arranged to be flush with the carriage when the carriage is adjacent thereto.

Preferably the series of compartments form a stack which is removably connected with the distribution compartment.

The distribution compartment may be rectangular.

The stack is preferably rectangular.

The compartments may have parallel open faces which are arranged to receive an article from the carriage.

The guides may be parallel to the flush open faces of the compartments.

The carriage desirably comprises parallel side members which are attached to the guides for slideable movement therealong.

The parallel side members may have holes therethrough at each end, which holes engage a respective guide for movement therealong.

Preferably the holes are provided with an internal thread which engages a corresponding thread of the guides, whereby rotation of the guides moves the parallel side members therealong.

According to an alternative embodiment of this aspect of the present invention the carriage comprises parallel side portions located approximately in the centre of respective sides of the carriage, the parallel side portions comprising holes which engage the guides for movement therealong.

Rotation of the guides about their longitudinal axes may be arranged to move the carriage along the guides.

The direction in which the carriage is moved along the guides may be determined by the direction of rotation of the guides.

Preferably the corners of the carriage are stabilised by shafts received therethrough which run parallel to the guides and allow slideable movement of the carriage therealong.

According to an alternative embodiment of this aspect of the present invention the carriage is connected to the guides through a gearing system which is arranged to be driven by a motor to move the carriage therealong.

Preferably the carriage has a front which is arranged to be closest to the storage assembly.

The support may comprise a conveyor belt.

The support may comprise two parallel conveyor belts which form opposite sides of the support.

Preferably the belts are arranged to extend perpendicular to the direction of the guides.

Preferably the belts are arranged to extend laterally to the direction of the guides.

The conveyor belts may be arranged to extend from the back of the carriage to the front of the carriage.

The receptacle may comprise a drawer.

The drawer may have side walls which have slots of a matching configuration to the sides of the article.

Optical sensors may be arranged to detect the article.

Preferably a back surface of the drawer is hinged to a frame work of the apparatus.

The drawer may comprise a slot in its base, which slot is arranged to guide a pusher for moving an article in the drawer when the article is in the predetermined position and the drawer is in a conveying position.

The drawer pusher may comprise an upper and lower member, the upper member being for pushing an article in the drawer and the lower member being for engaging an engagement member of support.

Preferably the upper member is arranged above the base of the drawer and the lower member is arranged below the base of the drawer.

The upper member may be connected to the lower member through connecting rods which extend through the slot or slots so as to allow the pusher to be slideably moved along the slots.

The upper member may be arranged at the back of the drawer and may have a pusher surface for pushing an article in the drawer.

The support may comprise an engagement member which is connected between the belts, for engaging the lower member.

Preferably when in the off-loading position, the engagement member engages the lower member and when the carriage moves away from the on-loading position, the engagement member is disengaged from the lower member.

Preferably the support belts are arranged to be driven to move the engagement member between the back and front of the support.

The support is preferably mounted on rails.

Preferably the drawer is hinged and once loaded with an article is pivoted to a position where the lower member engages the engagement member.

The pusher may be biased to the back of the drawer by a spring.

Preferably operation of the belts to move the engagement member, when engaged with the lower member, to the back of the support, moves the pusher upper member from the back to the front of the drawer.

The lower member may have front end portions spaced apart by at least the distance between the conveyor belts, as measured from the outside edges.

The lower member end portions may be arranged to be lower than the belts, when engaged by the engagement member.

Preferably the engagement member comprises an abutment member for contacting an article located on the belts.

Preferably when the carriage is in an off-loading position the belts are operable to move the engagement member to push the article into an empty storage location.

The distribution compartment and guides may define an elevator shaft with the carriage being the elevator and the storage locations defining different levels at which the carriage is arranged to stop.

According to an alternative embodiment of this aspect of the present invention the article is loaded directly onto the carriage and the support is only for off-loading the article to an empty storage location.

According to another embodiment of the present invention the storage locations are provided on opposite front and back sides of the carriage.

According to another embodiment of the present invention storage locations are provided at positions around the periphery of the carriage.

According to another embodiment the transfer means is guided by a cable system.

According to another embodiment the transfer means is guided by a rack and pinion system.

Preferably the cable system is operable to move the carriage between on-loading and off-loading positions.

Preferably the carriage is in the form of a compartment for receipt of the article.

Alternatively the carriage is in the form of locating members.

According to an alternative embodiment of the present invention an article is arranged to be moved from the carriage to an empty storage location by means of a pusher of the carriage.

Preferably the pusher is movable from the back to the front of the carriage by a driving means.

Preferably the driving means is a threaded rod which engages part of the pusher, whereby rotation of the threaded rod moves the pusher therealong.

An alternative embodiment is the use of a belt to move the pusher assembly.

According to an alternative embodiment of this aspect of the present invention an article is moved from the drawer by a conveying member which is arranged to move the article to the carriage.

Preferably the control means is in the form of a data processor.

Preferably the apparatus is provided with sensors to indicate the position of the carriage and/or the article, within the apparatus, or stepper motors or alternative electromechanical arrangement which allows a control system to be aware of the position.

Preferably the apparatus is provided with a display means for indicating if an article received in the drawer, is acceptable, and to instruct the user in regard to the use of the apparatus.

Preferably the apparatus comprises indicators for indicating the number of empty locations in the storage assembly.

Preferably the storage assembly may be removed from the apparatus when full and replaced by an empty storage assembly.

Preferably the control means comprises a remote monitoring system.

Preferably the control means comprises a means of identifying the depositor.

Preferably the dispenser comprises a stack of articles which are individually moveable to an outlet location for withdrawal therefrom.

Preferably an article is dispensed from the dispenser when an article is received in the drawer.

Preferably the storage assembly comprises a plurality of storage locations in the form of compartments.

Preferably the storage assembly comprises a column of storage compartments.

Each column preferably comprises a plurality of rows of compartments.

Preferably the column of compartments comprises an on/off-loading face.

Each on/off-loading face is preferably a single row wide.

Preferably the width of the on/off-loading face is substantially the same as the width of the front face of the distribution compartment.

Preferably the receiving/dispensing means incorporates the off-loading and on-loading means.

Preferably the receiving/dispensing means comprises a guide.

It is preferred that each row of compartments comprises a guide.

Each guide may comprise a pair of rails.

Preferably each guide is arranged to move an article into or out of one of the compartments.

Preferably the receiving/dispensing means comprises a conveyor means.

Preferably the conveyor means comprises an abutment means which is arranged to move an article along the guide.

Preferably the conveyor means is for moving an article from one compartment to the transfer means.

The conveyor means may be arranged to move an article from one compartment to the carriage of the transfer means.

The conveyor means is preferably movable between an end compartment and a front compartment of each row of compartments.

Each row of compartments in the column may be provided with a respective conveyor means.

The guide preferably comprises two rails which extend between the end compartment and the front compartment.

The conveyor means may comprise a moveable pusher which is arranged to push each article in a row of compartments.

Preferably each compartment is arranged to store one article.

Preferably the movable pusher is guided by the rails.

Preferably the rails are arranged to support each article in its respective compartment.

Each pair of rails is preferably moveable parallel to their longitudinal axes.

Each rail may be supported on a base of the row of compartments.

Each rail is preferably arranged on opposite sides of the row of compartments.

Each rail preferably comprises an engagement means for engagement with the engagement member of the support of the carriage.

The pusher means preferably is slideable along the rails.

When each of the compartments in a row is full, preferably the pusher means is arranged to be located at the rear end of the rails.

For each row of compartments, each article in each compartment is preferably arranged to be supported on the rails.

The pusher may comprise a panel slideably connected to the rails through first and second guide blocks.

Each guide block may comprise a locking means for locking it to its rail.

The support of the carriage may be arranged to move the rails parallel to the sides of each compartment from the rear end of the row to the front end.

The engagement means may comprise a catch located at the front end of each rail.

The rails may be biased to return to a starting position.

Preferably in the starting position, the front end of the rails does not extend beyond the front face of the column of compartments.

The rails may be biased by springs to return to the starting position.

The pusher means may be arranged to be ratcheted along the rails.

Preferably the pusher means when located between the back and front end of the rails is only able to move towards the front end of the rails.

Preferably each time the rails are returned to their starting position, the pusher means is maintained in its current position.

The rails may comprise ratchet means for preventing the pusher means from moving backwards along the rails.

Preferably the first and second guide blocks allow the rails to slide beneath them when they are returned to the starting position.

According to another embodiment of this aspect of the present invention the first and second guide blocks are arranged to engage with base portions of each compartment to prevent them sliding back with the rails to the starting position.

The pusher may be driven by a motor.

When the pusher reaches the front end of the rails, preferably the motor is arranged to return it to the back end.

Preferably the motor is controlled by the control means.

The pusher may be arranged to stop at predetermined points on the rails.

The predetermined points may correspond to intervals which are greater than the width of an article.

The predetermined points may correspond to intervals corresponding to the border between corresponding compartments in one row.

Preferably the predetermined points correspond to a position directly behind an area where an article is to be stored.

Preferably each compartment is sized to hold a plurality of articles in a row.

Preferably each article is supported in a row on the rails.

Preferably each row of compartments is replaced by a single compartment, sufficiently long to accommodate a plurality of successive articles.

The present invention yet further provides an apparatus for storing new articles and dispensing new articles, comprising a first and second storage area, the first storage area being arranged to receive a used article in a first receiving location whereby it can be transferred to a first storage zone, the second storage area comprising a plurality of articles for dispensing, wherein insertion of a used article into the receiving area results in the used article being transferred to a first storage zone and in the dispensing of an article from the second storage area.

Preferably the used article is arranged to be inserted manually into the receiving area and physically pushes a pusher means which pushes an article from the second storage area out of the apparatus.

The second storage area may comprise a stack of articles which moves downwardly a level each time an article is dispensed.

The second storage area may comprise a dispensing area located at the bottom of the stack.

Preferably the receiving area comprises a draw which is movable to the dispensing area to push an article therefrom.

The draw may be spring loaded to return the receiving area and drop the used article into the first storage zone.

The first storage zone may be located adjacent the second storage area.

The first storage zone may be located underneath the dispensing area.

When the draw is located in the dispensing area, the used article may be arranged to be passed to the first storage zone therebelow.

Insertion of a used article into the receiving area is preferably activated by a lever arrangement which dispenses an article in the dispensing area.

According to another embodiment of this aspect of the present invention there is provided an apparatus for dispensing items, comprising a receptacle for a stack of items, a roller means for moving an item to a dispensing zone and a means for dispensing an item when a sensor indicates that an item should be dispensed.

Preferably the apparatus for dispensing items is linked with an apparatus for storing and dispensing articles and is arranged to dispense an item when the apparatus for storing and dispensing articles, receives an article.

The receptacle may be arranged to release an item at the bottom of the stack, to the transfer area, whereby it can be moved by the roller means to the dispensing zone.

Preferably the roller means comprises a plurality of rollers and levers.

The dispenser apparatus may comprise sensors for indicating when an item is in the transfer area.

The items preferably are held between two rollers of the roller means when in the dispensing zone.

Preferably the roller means comprises a first roller which comprises a cam surface for moving the item to a second roller in a waiting zone.

From yet a further aspect, the present invention provides a storage apparatus for facilitating recycling of complex articles, comprising storage space for storing used articles for recycling, detection means for detecting the storage of a used article, identification means for identifying a user of the apparatus and recording means for recording the number of used articles stored by the identified user.

In this aspect, therefore, the invention gives an apparatus which is arranged to store articles for recycling and which does not necessarily dispense replacement articles, although embodiments may also provide a dispensing function.

Recordal of the number of items stored can be by individual users, groups of users (eg companies) or by machine site. Knowledge of the number of articles stored in the machine by a user enables examination of quantities of stored articles to be picked up by a servicing agent and also facilitates pricing for replacement items provided to the user. Where the apparatus is merely a storage apparatus, and has no dispensing function, replacement articles may be provided by independent supply contracts not related to the machine itself other than to determine the pricing and quantity to supply, or by electronically generated orders which are generated automatically by the supplier upon receipt of pre-determined control signals issued to the supplier by the apparatus.

For example, the number of items stored by a user may determine a discount on replacement articles.

This aspect of the present invention may include any or all of the features of the other aspects of the invention discussed above.

From yet a further aspect, the present invention provides a storage apparatus for facilitating recycling of complex articles, comprising storage space for storing used articles for recycling, detection means for detecting storage of a used article, identification means for identifying the user of the apparatus, and reward means for instigating issuance of a reward to the user.

The reward which may be issued may be in the form of a lottery ticket or other reward issued by the machine, or may be issued by the servicing agent at a later stage. Preferably, the machine includes recording means for recording the number of articles stored by the user. The reward may vary depending upon the number of articles stored in a period of time, for example.

This aspect of the invention may include any or all of the features of the other aspects of the invention discussed above.

Features and advantages of the present invention will become apparent from the following description of embodiments thereof, by way of example only, with reference to the accompanying drawings, in which;

FIG. 4 is a perspective view from above and one side of a receptacle drawer of the apparatus of FIG. 3;

FIG. 5 is a perspective view from above and one side of an upper part of a drawer pusher for the drawer of FIG. 4;

FIG. 6 is a perspective view from above and one side of a lower part of a drawer pusher for the drawer of FIG. 4;

FIG. 1 is a generalised schematic block diagram giving an overview of a system in accordance with an embodiment of the present invention for facilitating recycling of complex articles, such as printer cartridges, toner cartridges and the like.

Figure 1:
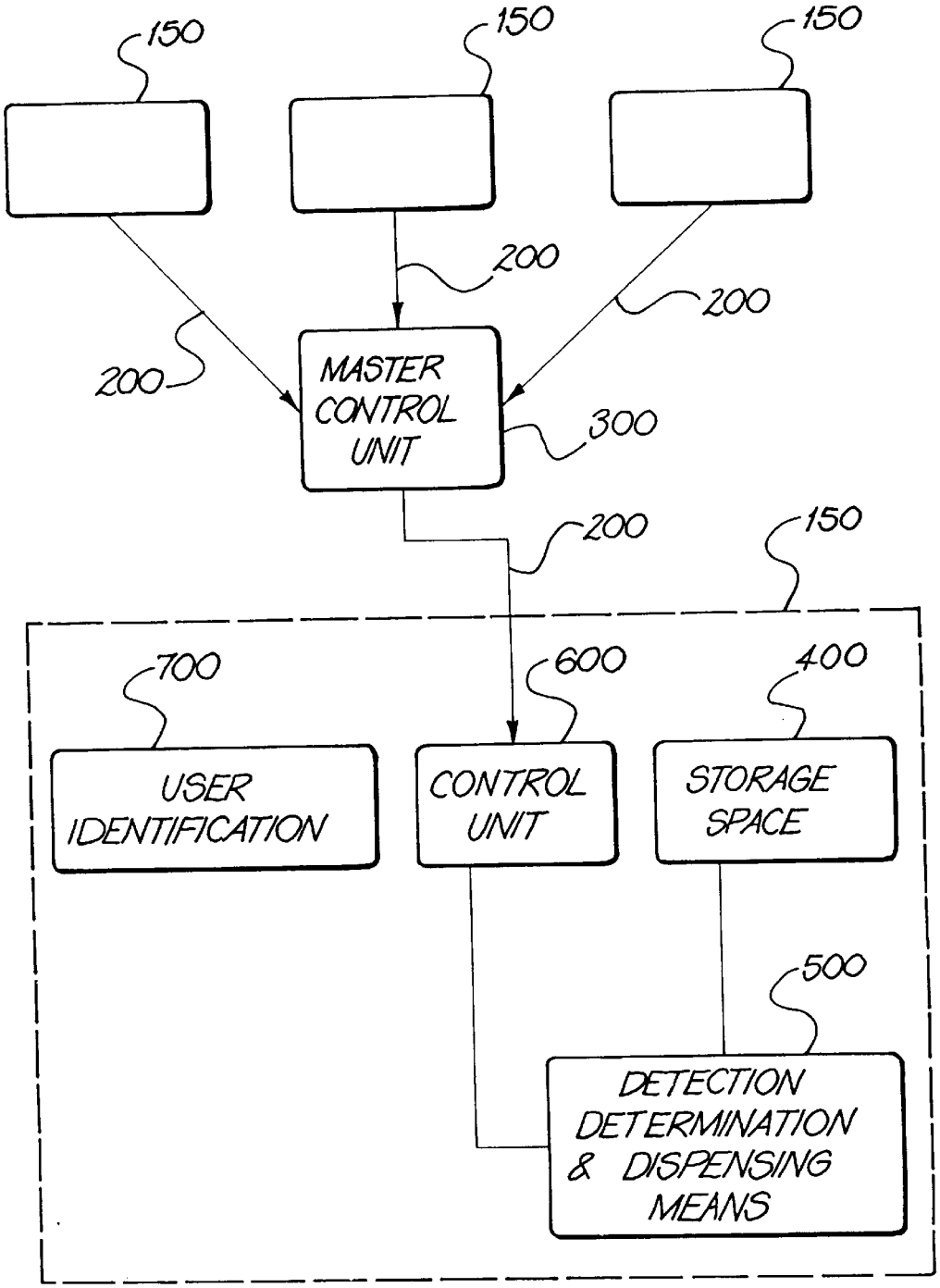
FIG. 1 is a schematic block diagram of a system for monitoring and controlling the storage of used articles and the dispensing of new articles, in accordance with an embodiment of the present invention.

The system comprises a plurality of apparatus for storing and dispensing used articles, designated by reference numeral 1. Each apparatus 150 is connected, by means of a communication link 200 to a master control unit 300. Each apparatus 100 comprises a storage space 400 for storing used articles for recycling and new articles for dispensing; a detection, determining and dispensing means 500, for detecting the used article to be stored, determining whether it is of an appropriate type to be stored and for dispensing new articles; a control unit 600 for controlling the apparatus 150, and a user identification means 700 for identifying a user of the apparatus 150.

In operation, the apparatus 150 will be established in a convenient location, such as a retail shop, an office or the foyer of an office building, where it can easily be accessed by users requiring replacement printer cartridges, toner cartridges, etc and wishing to recycle used toner cartridges, printer cartridges, etc. If a user wishes to store a used article for recycling and/or obtain a new article, he identifies himself to the apparatus by means of user identification means 700 (which may include a magnetic striped card reader for example, for reading a magnetic striped card possessed by the user) and then indicates to the apparatus 150 which transaction he requires, by means of a keyboard or touch screen (not shown) associated with the control unit 600. The control unit 600 records the details of any transaction, eg how many used articles have been lodged in the storage space and how many new articles have been dispensed. This information may be used for auditing purposes, for calculating a financial credit or received for lodgement of recyclable material or a charge to the user, and is also used to determine whether the user is entitled to receive a new article, ie if the ratio of new articles dispensed to used articles stored for that particular user will exceed a predetermined limit then a new article will not be dispensed until a further used article has been stored for that user. This encourages recycling. The system may also be set up to accept storage of recognisable recyclable materials without the need for users to identify themselves.

The master control unit 300 will generally be established at a location remote from the storage and dispensing apparatus 150. The system is intended to facilitate an auto-servicing role. Each apparatus may communicate with the master control unit 300 and vice versa. Communication means 200 is preferably by means of digital communication via a telephone link. The communication means 200 may comprise alternative means.

The major function of the master control unit 300 is to monitor the operation of the apparatus 100. In particular, the following major functions are provided;

1. When stocks of new articles are low, down to a predetermined number, the control unit 600 signals the master control unit 300 (or the master control unit 300 obtains this information by polling the apparatus 150). This prompts a servicing agent to attend the apparatus 150 in order to re-stock it.
2. The control unit 600 for each apparatus also indicates to the master control unit 300 when it has no more room for used articles and, again, this prompts a servicing agent to attend the machine to unload it of used articles for recycling. In some cases, particularly where the apparatus is arranged to store and dispense only a single type of article, the storage space 400 for new articles may be taken up by used articles once the new articles have been dispensed from the storage space 400. Re-stocking of new articles and unloading of used articles will be connected in this case and both operations may be prompted at the same time.
3. The master control means 300 will also be informed of faulty operation of the apparatus 1 so that a servicing agent can attend for repair. Faulty operation may include the situation where the machine has been tampered with or used incorrectly and the control unit 600 creates an alarm condition which is transmitted to the master control unit 300.

Information transfer between the master control unit 300 and control unit 600 of apparatus 150 may be implemented by conventional data transfer techniques. For example, the master control unit 300 may regularly poll each apparatus 150 to determine its status and/or an interrupt feature may be provided so that an apparatus can interrupt normal operation of the master control unit 300 to inform it of a change in the status of the apparatus 150.

As will be realised from the following description of embodiments of the apparatus 150, there may be a number of different types of apparatus 150 which can be used in the system, depending upon the particular requirements for the apparatus at a particular location.

Figure 2:
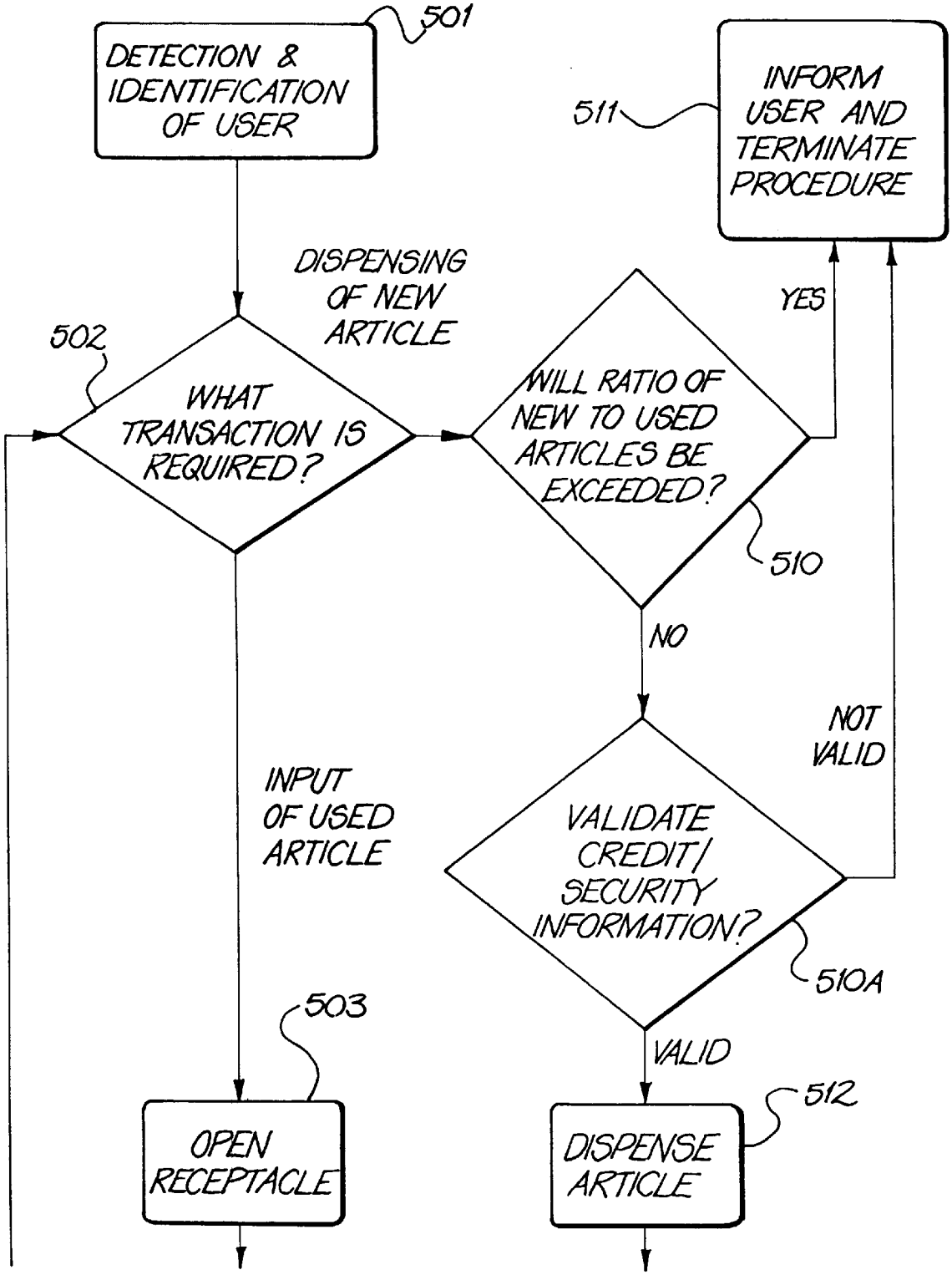
FIG. 2 is a flow diagram which schematically illustrates an operating procedure for a generalised embodiment of an apparatus for storing and dispensing articles in accordance with the present invention.
Figure 2:
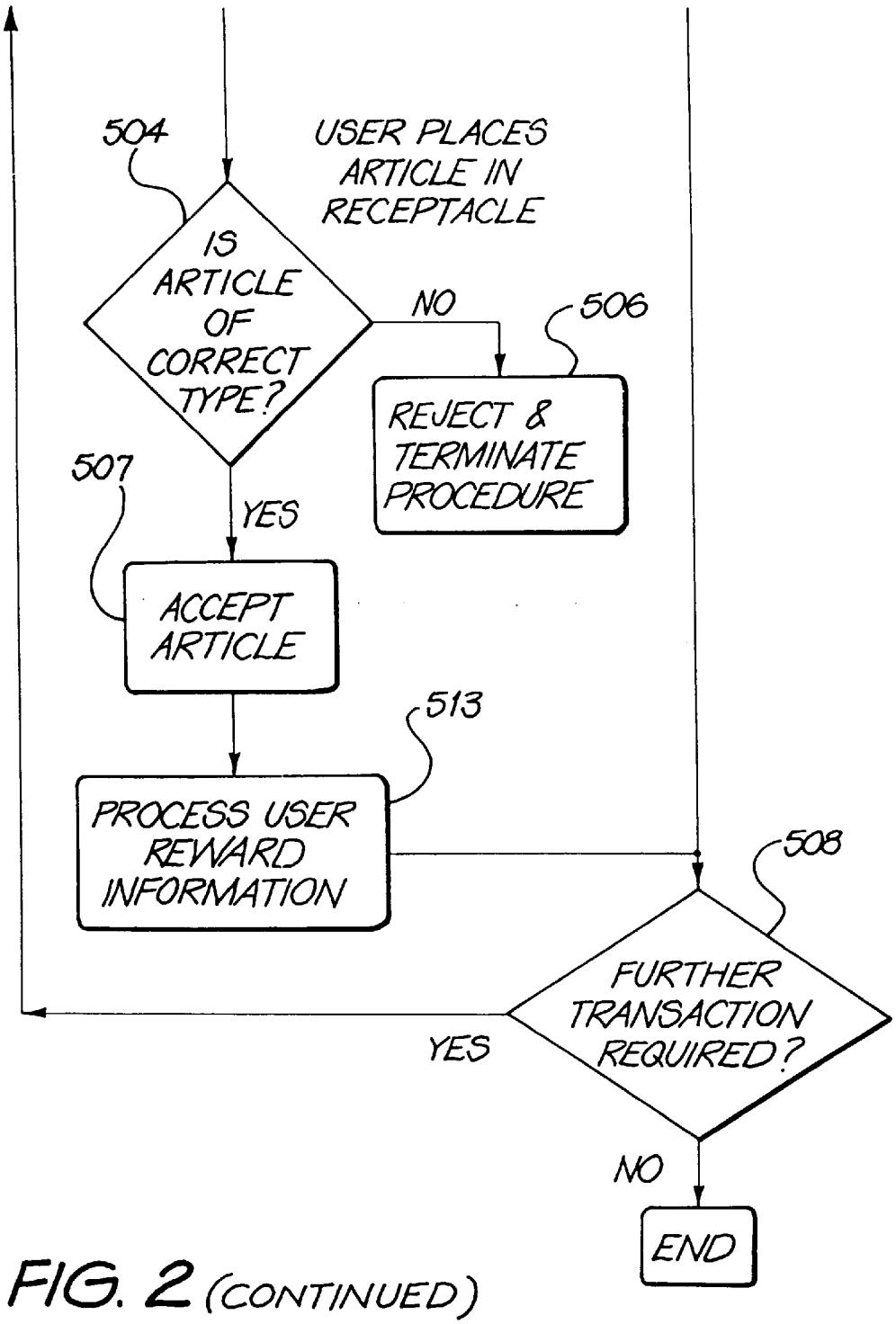

FIG. 2 is a flow diagram of an example operating implementation of the apparatus in accordance with the present invention. This is an overview of general operation only. As will be clear from the following, other operations are performed by the apparatus.

This flow diagram only shows the major aspects of a typical transaction process between user and apparatus.

A user who wishes to store a used article and/or obtain a new (possibly recycled) article approaches the apparatus 150 and is detected by a proximity detector (not shown). The control unit 600 includes a display unit (see later) and a keyboard. In step 501 the screen prompts the user to identify himself (in a similar manner as used in bank teller machines) and the user identifies himself by the use of user identification means 700, eg magnetic striped card reader and magnetic card. In step 502, the apparatus 150 prompts the user to indicate what transaction he requires to undertake with the apparatus 150. The prompt will again be by way of the visual display unit, although other prompts, such as a machine voice prompt, could be used in addition or as an alternative to the screen prompt. Via the keyboard, the user inputs information on the transaction he requires. Again, the keyboard may be designed along the lines of a typical bank teller machine and, for example, there may be a key labelled "input of used article" and a key labelled "dispensing of new article", or similar labels. A touch-screen may be employed.

If the user wishes to deposit a used article, at step 503 the control means 600 controls the apparatus to open a receptacle to receive the used article. The receptacle may be an actual storage location where the used article remains until it is collected by a servicing agent, or it may merely by a receiving area from which the article will subsequently be conveyed to a storage space or location. This will depend upon the particular embodiment of the apparatus 150 (see later). When the receptacle has opened 503 the user places the used article in the receptacle. A detection and determining means 500 within the receptacle detects that an article has been placed therein and determines whether it is an article of a correct type for storage in the apparatus 150. The determination is carried out by means of appropriate sensors (see later) detecting features of appearance of the article. In a preferred embodiment, physical features of the receptacle are shaped to conform with the shape of at least a portion of the article, so that the article will not fit correctly into the receptacle unless it is of the correct shape. For printer cartridges, toner cartridges and other complex articles which have fairly complex shapes, this is a good way of determining that the article is the correct article. The detecting and determining means informs the control means 600 that an article has been detected and whether or not it is of the correct type (step 504).

If the article is not of the correct type, the control means 600 prompts the apparatus 150 to reject the article (step 505) and terminate the transaction procedure (step 506). At the same time, the control unit 600 may inform the master control unit 300 of an attempt to incorrectly use the apparatus 150. The master control unit 300 may then prompt a service agent to attend the apparatus 150.

If the article is of the correct type the apparatus will accept the article at step 507 and the article will be stored in the storage space 400 (eg in the particular receptacle, or will be transported to another storage space or receptacle).

The apparatus is preferably arranged to indicate via a message to the user the environmental contribution made by depositing the recyclable material and the total contribution to saving of landfill waste made so far by the apparatus. Indication may be by means of the user display.

In step 513, after acceptance of the article ( 507) the control means may be arranged to determine whether or not the user is entitled to a reward for the number of articles he has deposited and may initiate provision of the reward to the user. The apparatus may incorporate means for providing a reward, such as means for printing a lotto ticket, for example. Alternatively, the master control means will be informed that a reward is due and the reward can be sent out to the user separately.

At step 508 the user will be asked by the display if a further transaction is required. If no, then the procedure will be terminated at 509. If yes, then operation returns to step 502 and the user will again be asked what transaction is required.

If the user wishes to obtain a new article he indicates this by appropriate actuation of the keyboard.

At step 510, the control unit 600 makes a determination as to whether the ratio of new articles to used articles will be exceeded if a new article is dispensed to the user. The ratio may be set at any desired level. For example, if the ratio is 3:1, the user will be entitled to obtain three new or recycled articles for every article he deposits. If he wishes to then obtain a fourth article without depositing a used article, the ratio will be exceeded and the control means 600 will not allow the new article to be dispensed (step 511). The user will be informed and the procedure will be terminated. If at step 510 the control unit 600 determines that the ratio of new to used articles will not be exceeded, step 512 is proceeded to and an article is dispensed to the user. Operation then proceeds to step 508 and the user is again asked whether a further transaction is required.

A further step 501A may be included between steps 510 and 512. This further step is a step to evaluate credit/security information of the user. For example, if the user has not paid his bills for previous issues of replacement articles then issuance of a further replacement article may be refused and operation proceeds to step 511.

The control means 600 will record all transactions against the particular user's identification. Transactions will be used for audit purposes, charging the user and for any other purposes for which the information may be required. Audit reports may be produced by a printer or display at the master control unit 300 or locally by the control unit 600. An example report is given in the following table.

| Report For: | Sample Organisation Pty Ltd | | | |
|---|---|---|---|---|
| For Period: | 1/6/92 to 30/6/92 | | | |
| Employee | Date | Time | Tran Type | Cart Type |
| John Smith | 5/6/92 | 10.31 am | Credit | EPS |
| John Smith | 5/6/92 | 10.32 am | Receipt | EPS |
| Joe Brown | 5/6/92 | 4.20 pm | Receipt | EPS |
| Julie Black | 6/6/92 | 8.56 am | Credit | EPS |
| Julie Black | 6/6/92 | 8.56 am | Receipt | EPS |
| Greg Black | 7/6/92 | 1.30 pm | Receipt | IBM |
| Julie Black | 7/6/92 | 2.43 pm | Credit | IBM |

"Credit" denotes that an article (in this case an EPS cartridge) has been deposited and "Receipt" denotes that a new or recycled article has been dispensed to the user.

The flow chart for FIG. 2 is a broad overview only. Many other functions may be provided by the apparatus, including the provision of accounts statements on request, facility for ordering directly from the master control means 300 extra articles, etc. A telephone link may be provided on the apparatus so that a user may speak directly to the servicing agent.

The telephone link may also be used for automatic ordering of replacement items (using an electronic data interface (EDI) linked to the control system) for delivery to the user who lodged the used article in the storage compartment. It is particularly useful for embodiments of the apparatus which do not have a dispensing operation, but merely a storage and ordering operation.

The refusal of the apparatus to dispense or order a new article if the ratio of new to used articles would be exceeded for that particular user creates the incentive to recycle (in embodiments without a dispensing operation, the apparatus may refuse to take or transmit an order, or the master control means (if connected) may refuse to process the order and/or send out replacement items to the client). A further incentive may be provided in the form of a reward dispenser, which dispenses a reward to the user when the user deposits a used cartridge. The reward may be in the form of a lotto ticket, for example, or other rewards.

Figure 3:
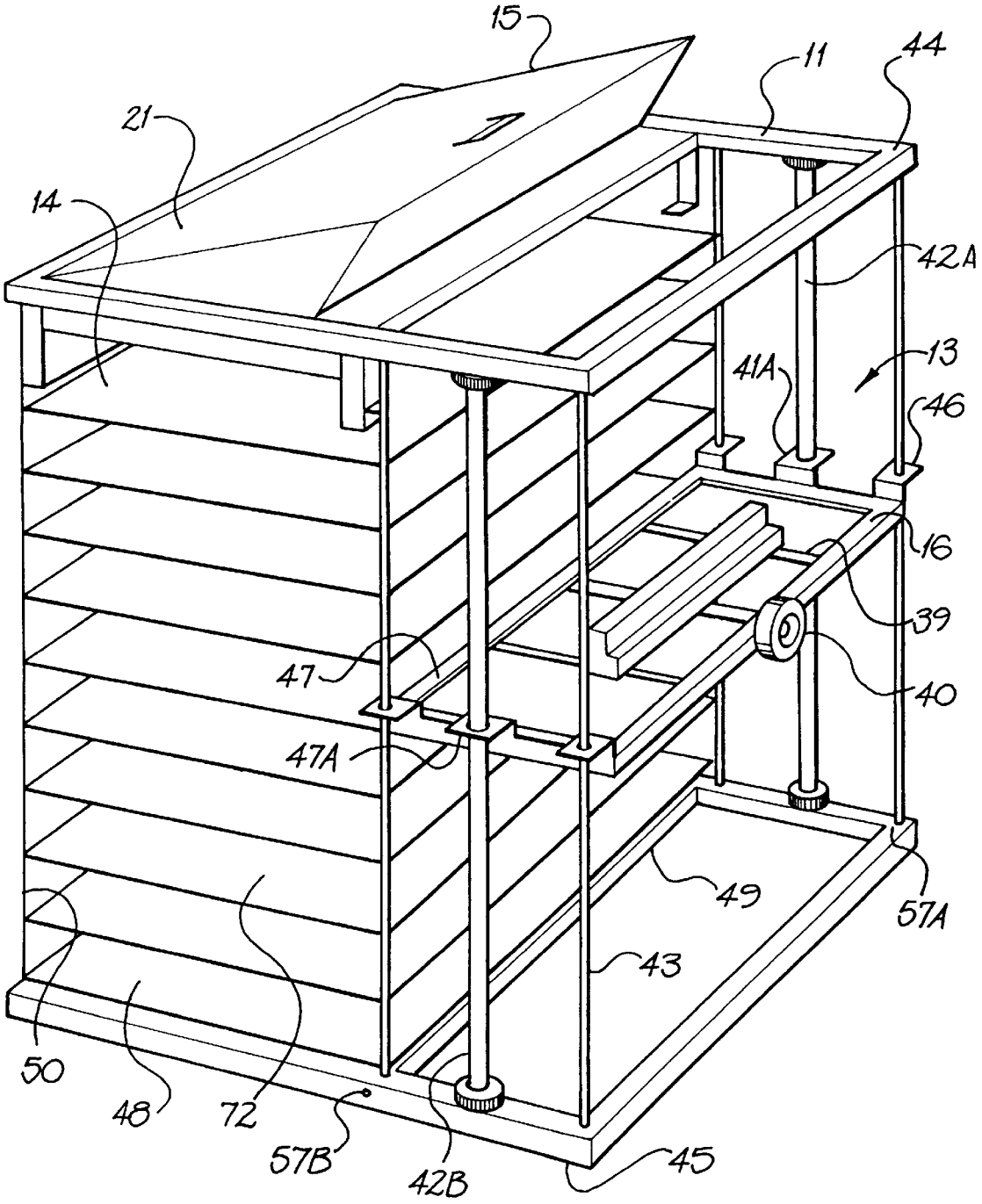
FIG. 3 is a perspective view from the front and one side of an apparatus for storing and dispensing articles in accordance with an embodiment of the present invention, the apparatus being shown without a security cover.

FIG. 3 shows an apparatus 150 in accordance with an embodiment of the present invention. The apparatus has a storage compartment assembly 12 having a plurality of storage compartments for storing used and new printer cartridges, toner cartridges and the like. The apparatus is shown without a cover. In operation, the apparatus would have a cover in order to make it secure to prevent unauthorised persons from accessing the storage compartments 12. Also, as will be seen later, this apparatus is connected to a control means 600 and identification means 700 to provide an apparatus 150. The parts of the apparatus shown in FIG. 3 comprise detection, determining and dispensing means 500 and storage space 400 of FIG. 1.

The apparatus comprises a rectangular frame 11 having a storage compartment assembly 12, an elevator compartment 13 and an upper drawer compartment 14 with drawer 15. The upper drawer compartment 15 provides a receptacle for receiving a used cartridge and dispensing a new cartridge.

Briefly a cartridge is loaded into the drawer, positively identified, and is then transferred onto a carriage 16 in the elevator compartment and the carriage 16 then moves the cartridge to one of the empty storage locations in the storage compartments 12.

Referring to FIG. 4, the drawer 15 is provided with side walls 17*a*, 17*b* which are each provided with slots 18*a* and 18*b* which are shaped to match the corresponding peripheral surface of a cartridge.

The base of the drawer 19 is provided with two longitudinal slots 20*a* and 20*b* extending from near the back of the drawer to a position near the front of the drawer. The slot 20*a* is located near side wall 17*a* and slot 20*b* is located near side wall 17*b*.

As shown in FIG. 3, the drawer also has a top 21 and the drawer is hinged at the top of its back wall to the frame 11.

Referring now to FIG. 5 and 6, the drawer pusher comprises an upper part 22 and a lower part 23. The upper part 22 has a rectangular base 22 a and a back wall 22*b* together with a top wall 22*c* which is angled upwardly from the back wall 22*b* and terminates in a small downwardly extending vertical wall 22*d*. The length of the top wall that extends from the back wall is slightly less than the distance between the back wall and the front of the base 22*a*.

The base 22*a* is provided with four holes 22*e* which are respectively arranged near the corners of the base so as to define the corners of a rectangle.

The lower part 23 is in the form of a base plate which has upwardly extending cylindrical members 23*a* aligned to mate with the holes 22*e* in the upper part 22.

The front of the drawer pusher 23 is provided with side portions 23*b* and 23*c* which are rectangular and are separated by a distance of just over 300 millimeters. The front of each of these side portions has a vertically downwardly extending lip 23*d* and 23*c*.

Figure 7:
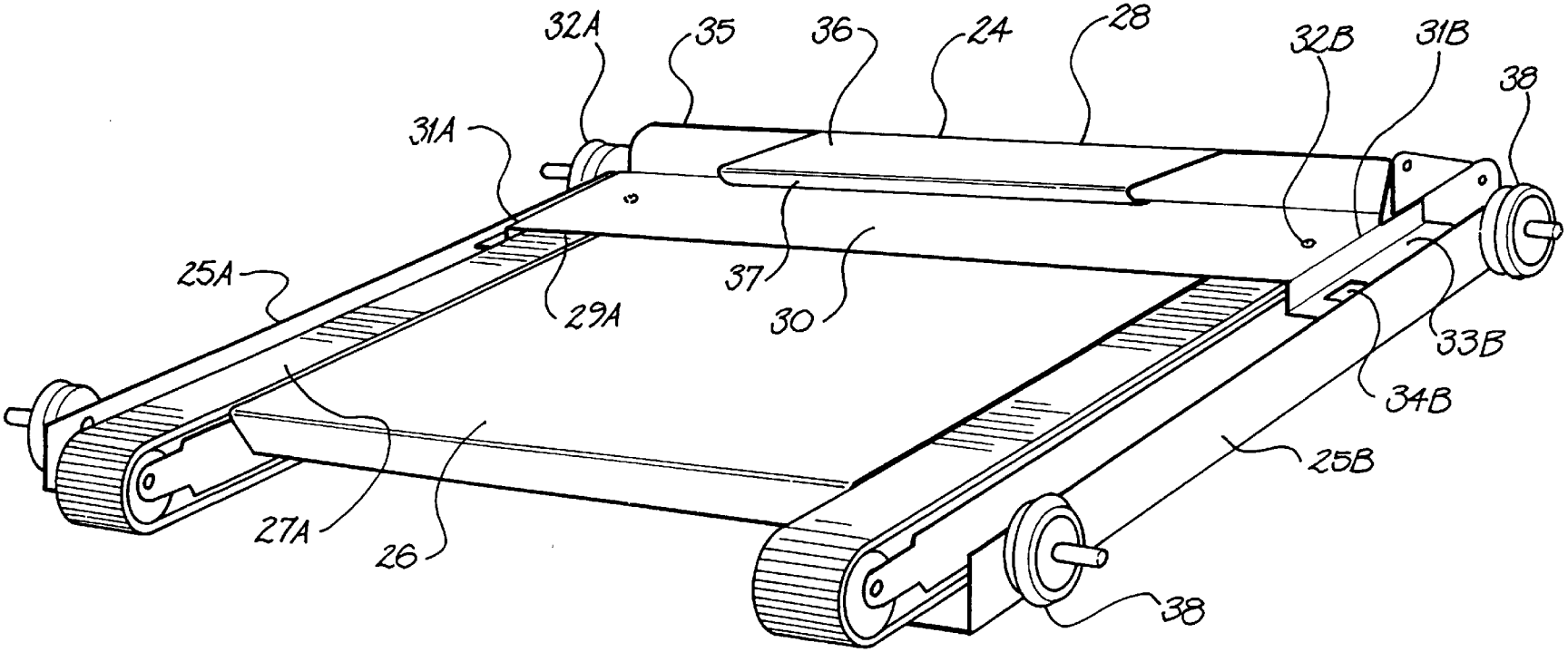
FIG. 7 shows a first variation of a stacker which may be used with the apparatus of FIG. 3.

FIG. 7 shows a first embodiment of a stacker 24 which is mounted on platform 16. The stacker comprises side brackets 25*a* and 25*b* which are connected together by means of a base 26. The two side brackets 25*a* and 25*b* are aligned in parallel and provided with conveyor belts 27*a* and 27*b* which are mounted to vertically upstanding walls of the side brackets 25*a* and 25*b* respectively and extend from the front of the stacker to the back of the stacker in parallel with the side brackets 25*a* and 25*b*.

A cartridge pusher 28, in the form of a cross-bracket interconnects the back of each belt and is connected to the top surface 29*a* and 29*b* of each belt. The cartridge pusher 28 comprises a horizontal base 30 with sides 31*a* and 31*b* which are flush with conveyor belts 27*a* and 27*b* respectively. These sides are connected to the conveyor belts 27*a* and 27*b* respectively by means of rivets or screws 32*a* and 32*b* respectively. The edges of the sides 31*a* and 31*b* are provided with right angled brackets 33*a* and 33*b* which extend vertically downwardly and then horizontally. Each of these brackets has a connecting slot 34*a* and 34*b* for receipt of lips 23*d* and 23*e* respectively of the drawer pusher.

The cartridge pusher 28 is also provided with a back wall 35 which extends vertically upwardly along the length of the base 30. An overhanging bracket 36 extends horizontally forward of the back wall 35 and is provided with a downwardly extending lip 37. This overhanging bracket 36 terminates on both sides short of the sides of the cartridge pusher.

On the outside and the back and front of each of the side members 25*a* and 25*b*, a locating pin 37 is provided to allow the stacker to be fixed in position on the platform 16.

Referring back to FIG. 3, the platform 16 is shown with a stacker 39 connected thereto in a central position. A motor 40 is provided at the back of the platform 16 and is for driving the conveyor belts of the stacker 39.

The platform 16 is effectively rectangular and comprises central lugs 41*a* and 41*b* extending outwardly on each side of the platform. These lugs are provided with holes which receive threaded bolts 42*a* and 42*b* therethrough. These rods act as guides and extend vertically between top and bottom frame members of the elevator compartment 13.

The elevator compartment 13 is a rectangular shaft defined by four vertical rods 43 which link upper and lower frames 44 and 45. These rods also act as guides for the platform 16 which is provided with lugs 46 at each of its corners. The rods 43 guiding the front of the platform are flush with openings in a stack of compartments forming the storage compartment 12. Likewise the front of the platform 16 is also flush with these compartments as it moves up and down the elevator shaft.

The storage containers form a column of rectangular compartments which are substantially identical. The openings of each of these compartments as previously mentioned are flush with the front of the platform 16 when it is adjacent thereto.

The stack of compartments 12 may also be removed as a single stack and replaced by an identical stack preferably by an opening at the side 50 of the apparatus 11. This facilitates servicing and re-stocking.

An alternative embodiment of the invention allows for each compartment to be slid forward through the elevator compartment to a pre-determined stop position, so that the cartridges may be removed and replaced through the front of the machine, if required because of space limitations.

Figure 8:
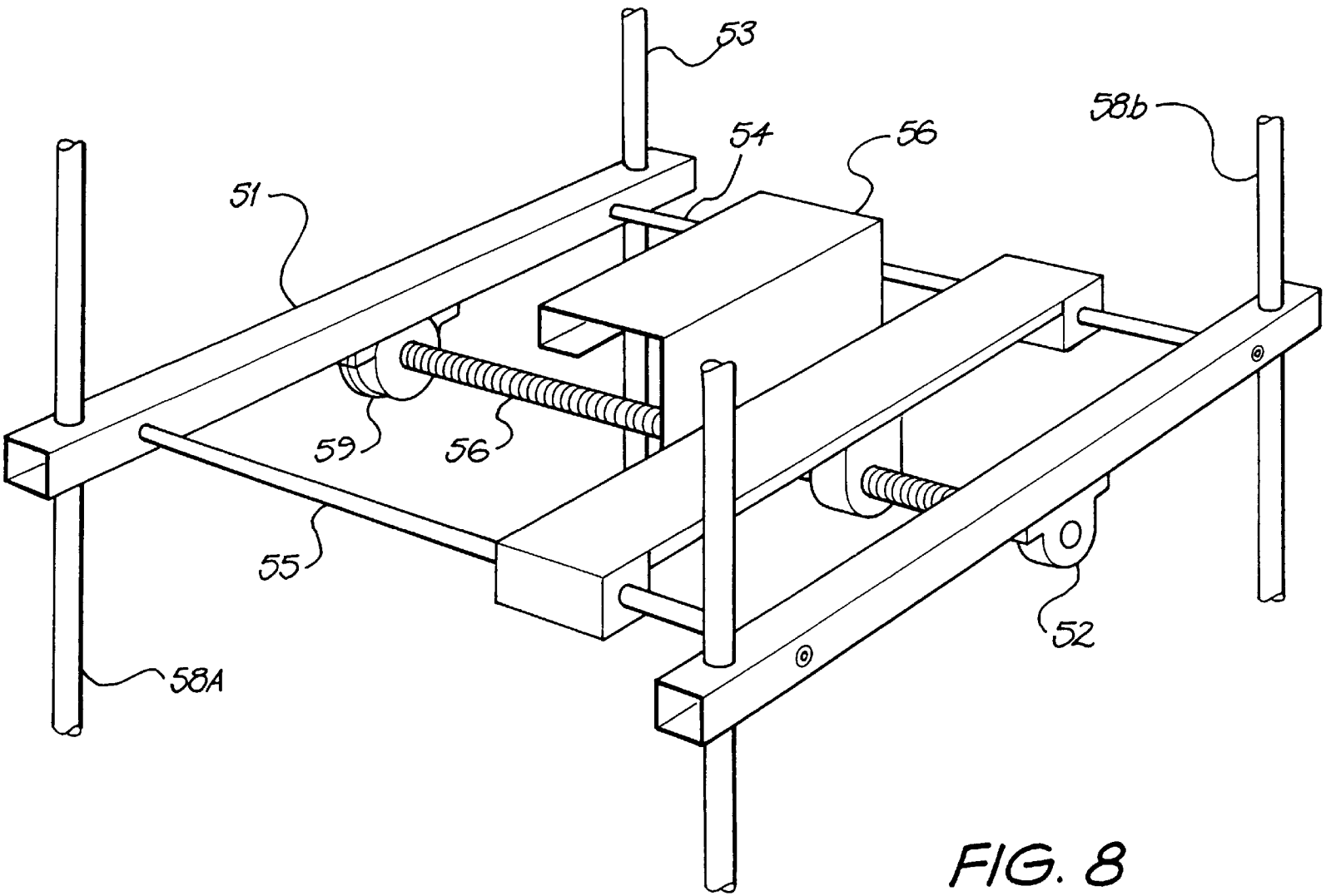
FIG. 8 shows a variation of a stacker which may be used with the apparatus of FIG. 3.

Referring to FIG. 8, another embodiment of the stacker is shown in which the platform 16 is in the form of parallel front and back bars 51 and 52 which are mounted on four vertical rods 53 located at the corners of the platform and received through holes located at respective ends of the members 51 and 52. Parallel guides 54 and 55 extend between the members 51 and 52 and a cartridge pusher 56 is mounted on these guides and is moved backwards and forwards by a rotatable threaded rod which extends between the two guides 54 and 55 parallel thereto and from the back member 52 to the front member 51.

Operation of the first embodiment of the invention will now be described with reference to the accompanying drawings.

Loading Cartridges

The apparatus described with reference to FIGS. 3 to 8 is intended to be used to receive used printer cartridges. The apparatus is controlled by a data processor (control means 600).

When the cartridge drawer 15 is ready to receive a used cartridge (see flow diagram FIG. 2 and associated description), the data processor will operate a motor which will allow the drawer 15 located at the top of the frame work 11, to open to allow a user to slide the cartridge into the drawer. Because the sides 17*a* and 17*b* of the drawer 15 are shaped to fit the type of cartridge required, only that type of cartridge will be received in the drawer. Optical sensors located in the drawer are used to ensure that the cartridge is fully entered into the drawer and when the drawer is closed by the user, the data processor will check the relevant sensors. If the cartridge is not acceptable because it is of incorrect shape, weight etc, the cartridge will not be accepted by the data processor and the drawer will reopen and an indicator (eg VDU) will indicate to the user that the cartridge must be withdrawn.

If the cartridge is accepted, the position of the drawer pusher with respect to the stacker will be such that the parts 23*d* and 23*e* of the drawer pusher are engaged in the connecting slots 34*a* and 34*b* of the cartridge pusher, which is located at the front of the stacker. The cartridge itself is located on the base of the drawer with the upper component 22 located behind it at the back of the drawer. The wall 22*d* of the upper component is in contact with the back of the cartridge.

The data processor then operates the conveyor belts 27*a* and 27*b* of the stacker so that they move the cartridge pusher from the front to the back of the stacker. In doing so, the cartridge stacker drags the lower component of the drawer pusher along with it because the drawer pusher is slideable within slots 20*a* and 20*b* of the drawer. The cartridge is then pushed out by the upper component of the drawer pusher. When the cartridge pusher is at the back of the stacker, the position of the upper component 22 of the drawer pusher is such that the cartridge is completely supported on the conveyor belts 27*a* and 27*b*. When this occurs either limit switches or optical sensors indicate to the data processor that the cartridge pusher is at the back of the stacker and therefore the cartridge is loaded. The cartridge stacker is then ready to commence its descent to an empty storage compartment.

Although not shown in the drawings, the drawer pusher is connected to the back of the drawer by means of a spring which is extended when the drawer pusher is dragged out of the drawer by the cartridge pusher. Consequently, when the stacker descends from the loading position, the parts 23*d* and 23*e* of the drawer pusher are disengaged from the connecting slots 34*a* and 34*b* of the cartridge pusher and the drawer pusher is then pulled back into the drawer by the spring. In such a position it is then ready to receive another cartridge.

Vertical Movement of the Stacker

Vertical movement of the stacker is controlled by the data processor which operates motors 57*a* and 57*b* located at the bottom of the elevator shaft.

The motors 57*a* and 57*b* operate to turn the rods 42*a* and 42*b* so as to move the platform 16 up or down. When the stacker 39 is loaded as previously described, the motors turn the rods so that the platform on which the stacker is located moves down to an empty compartment. It is preferred that each of the compartments are provided with sensors which indicate if they are empty or occupied. In addition, the location of each compartment can be preprogrammed in the data processor or can be indicated by sensors at the opening of each compartment. In any event, once the platform is aligned with an empty compartment, the motors 57*a* and 57*b* are stopped and the motor 40 is operated by the data processor to move the cartridge pusher (39 in FIG. 1). The conveyor belts 27*a* and 27*b* are thus turned and the cartridge pusher (28 and 39) pushes the cartridge off the conveyor belts 27*a* and 27*b* into the adjacent empty compartment. Once this is done, the data processor records the entry of the cartridge and controls the platform so that it returns back to the top of the elevator shaft ready for another on-loading operation.

In another embodiment it is envisaged that the cartridge pusher can extend beyond the front of the conveyor belts 27*a* and 27*b*. Thus, when the platform 40 is aligned with an empty container, the cartridge pusher can eventually extend partway into the compartment and must thus be slightly withdrawn before ascent of the platform 40. A similar situation can then arise at the on-loading area at the top of the elevator shaft where the conveyor belts 27*a* and 27*b* can be operated to move the cartridge pusher beyond the front of the stacker so that the drawer pusher engages in the connecting slots of the cartridge pusher.

In another embodiment a number of cartridges could be stored in a single compartment so that the motor driving the conveyor belts would have sufficient power to enable the cartridge pusher to push a cartridge from the conveyor belts and also push a cartridge at the front of the compartment to the back of the compartment to allow space for the latest arriving cartridge.

Sensors

Typically, optical sensors each comprising a light emitting diode and a photo transistor are mounted vertically at each front corner of the drawer such that the light will only be obstructed when the front of the cartridge is fully pushed into the holder. This ensures that both the cartridges are fully pushed into the holder and that if both light beams are broken that the cartridge is the correct width. Two more sensors are placed horizontally one towards the bottom of the holder at about the mid depth and one towards the top of the holder towards the rear. The height of the cartridge is checked by these two sensors. Such an arrangement will give adequate positional sensing for a cartridge.

A sensor will be used to show that the cartridge pusher has returned to its fully retracted position after the cartridge has been loaded onto the stacker belt and again before the drawer is open to receive the next cartridge. Also two sensors will be used to show that the drawer has reached the fully opened and fully closed positions respectively. These three sensors could be of the optical, microswitch or proximity type.

All of the above sensors are continuously monitored as the cartridge is being pushed out of the drawer onto the stacker belt. Thus, providing a check of the cartridge movement in comparison with the movement of the stacker belt.

In the second embodiment of the stacker shown in FIG. 5, a similar method of operation is used to that previously described. The main difference is that the driving rods 53 are located at diagonally opposite ends of the platform and are indicated by reference numerals 58*a* and 58*b*. In addition, instead of the conveyor belt assembly used in the first embodiment, a screw rod 56 driven by a motor 59 is used to control movement of the cartridge pusher 56.

Dispenser

The apparatus also incorporates a dispenser which houses a plurality of new or replacement cartridges.

In particular situations, for example, when a used cartridge is received in the drawer 15, and a new cartridge is requested by a user (see FIG. 2 and associated description), the data processor will indicate that a new cartridge can be dispatched from the dispenser. In such a situation, one of a stack of new or replacement cartridges is provided at an outlet of the dispenser and the user can then take this new cartridge as required. Cartridges may be dispensed by way of drawer 15 in an operation similar to but the reverse of storage A mechanism for removing cartridges from storage compartment S receiver (see FIG. 9).

According to another variation of the present invention, the apparatus may dispense a reward in the form of lottery tickets, cash, vouchers or similar items. Also a record can be kept of credit so that a number of deposits of used cartridges will accrue a corresponding number of credits until sufficient to cover the dispensing of a free replacement item or payment in another form. The reward dispenser is controlled by the data processor which has inbuilt security protection to avoid the accidental dispensing of items in the case of malicious damage or data processor failure.

The reward dispenser signals to the data processor when stocks of items to be dispensed fall below minimum stock values. The data processor can then electronically record the stock levels of items stored without the need to manually count them. Alternatively, an electronic printing device can be used to print reward details in place of a dispensing mechanism.

The apparatus incorporates a visual display unit (VDU) to provide the user with an easy means of selecting reward items, dispensing of replacement items and control of all recycling functions. In addition to the visual display, the apparatus incorporates a computerised audio output system fed by a voice chip to prompt the user and to promote the incentives available to the user through the use of the recycling machine.

A standard telephone link connects the local processor with a remotely located computer (master control unit 300) with the apparatus and records and reports on:

1. Stock levels of recyclable materials lodged in collection bins in the apparatus;
2. Stock levels of reward material stored in the reward dispenser;
3. Stock levels of replacement material stored in the output dispenser;
4. Usage rate of above mentioned items;
5. Billing and accounting information relevant to issuing credits and payments for recyclable materials lodged in the collection bin and replacement items dispensed from the output dispenser;
6. Usage statements (by user and total) and recycling statements for use in public relations; and
7. The requirement for user assistance or machine service.

Each apparatus and user of the apparatus would have its own preset ID to provide individual accounting.

The recycling machine can therefore replace the involvement of telemarketing and field sales persons in the servicing of clients who have opted to install the recycling machine (apparatus). The user organisation can eliminate the need to have a purchasing officer involved in the collection of recyclable materials and the issuing of replacement materials and monitoring of stock levels for reordering.

The host computer (data processor) may also contain customer data base systems that record all information relevant to serving the customers where the recycling machine is located.

The apparatus is provided with pin number features so that access to the apparatus is only provided once a keyboard or touch board has been operated to enter a pin number. A correct pin number would then allow operation of the apparatus to either receive a used cartridge or dispense or order for delivering from the supplier a new cartridge. Operation of the apparatus can then be monitored and output data can be provided on the operator.

By having a remove monitoring system, central control can monitor a number of apparatuses and can keep up to date information on all customers using the apparatuses.

Such a system can also be used to check operation of all components in the apparatus.

Figure 9:
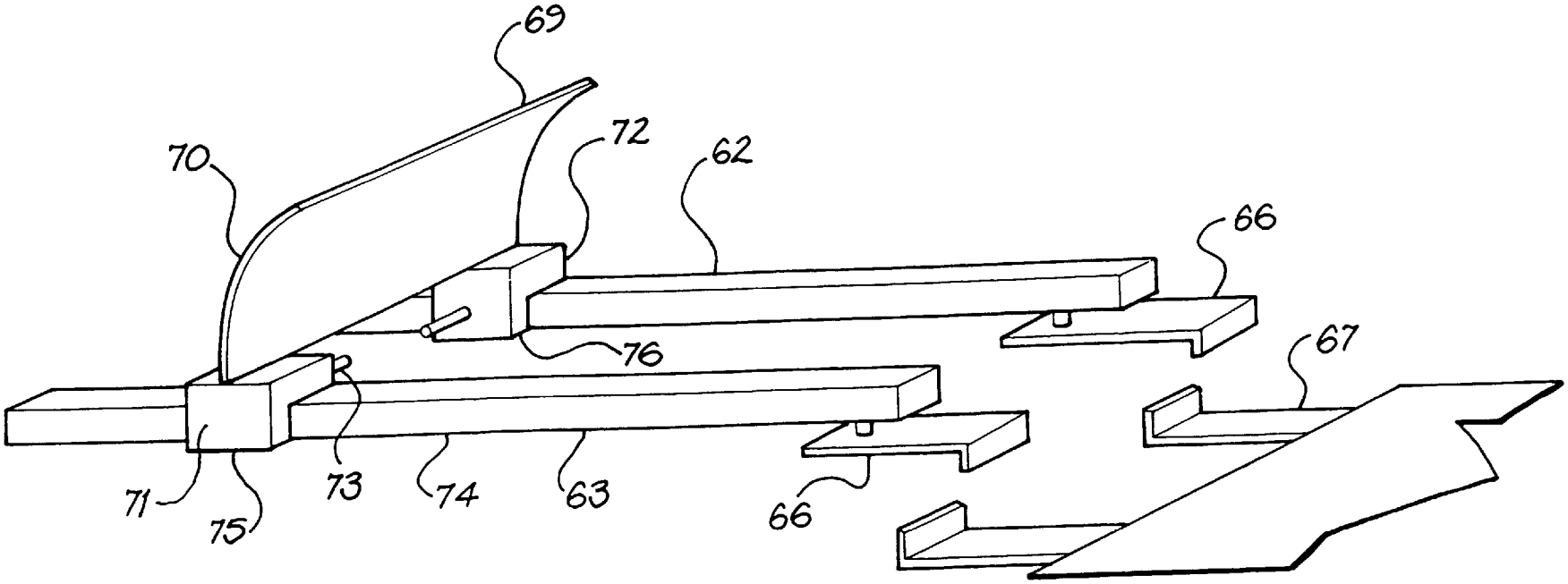
FIG. 9 shows a variation of a shelf pusher mechanism which may be used with apparatus in accordance with the present invention.

Utilising the shelf pusher mechanism as shown in FIG. 9, the apparatus shown in FIG. 3 is adapted to operate as both a receiver for used articles and a dispenser for new articles.

Referring to the apparatus of FIG. 3, the storage compartment 12 is increased in size so that the depth D of each compartment is of a sufficient size so that a number of cartridges can be stored in each level.

Figure 10:
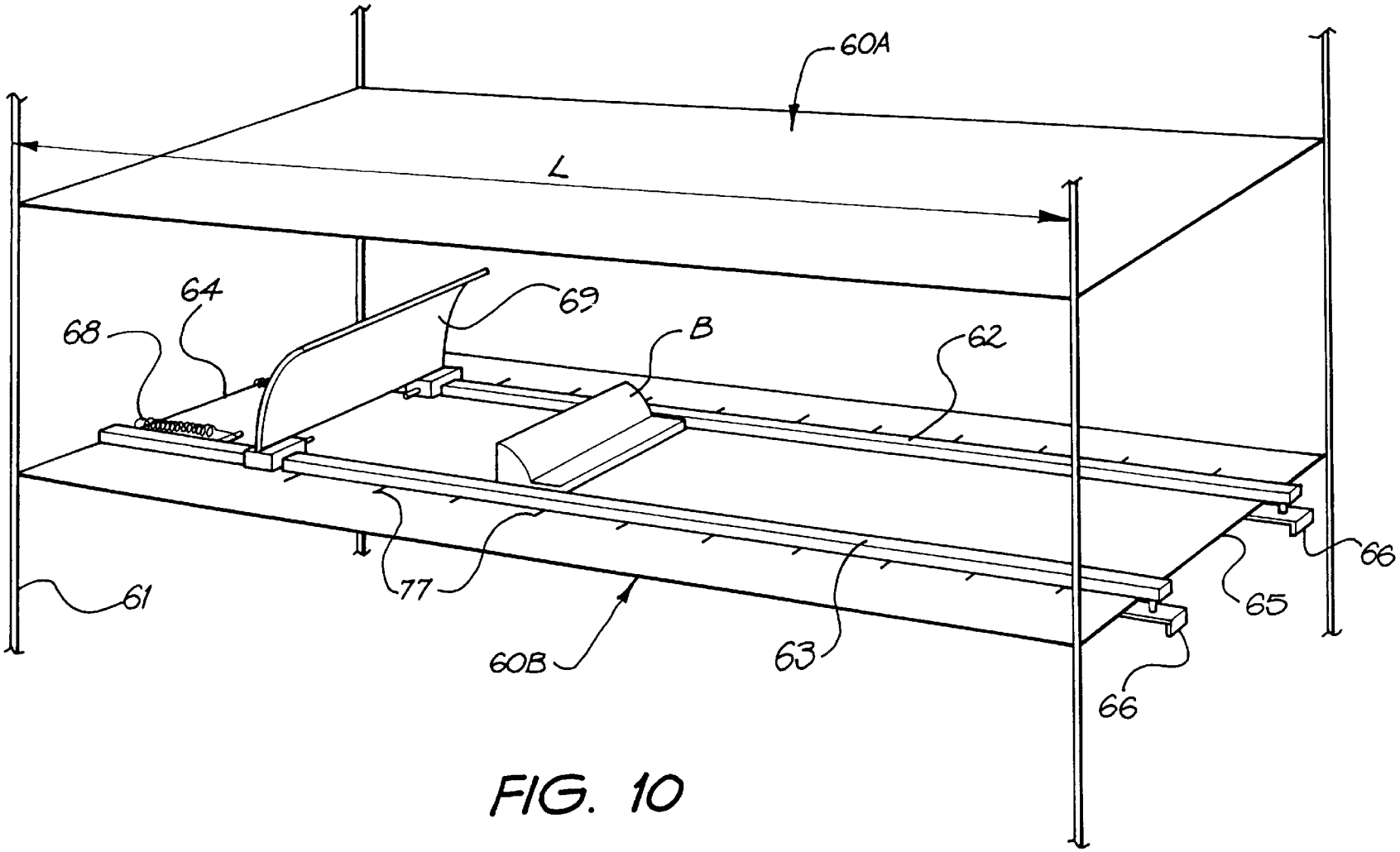
FIG. 10 is a front view of one compartment in a storage compartment assembly according to an embodiment of the invention which may be used with the shelf pusher mechanism of FIG. 9.

For simplification FIG. 10 shows two levels with the lower level provided with a shelf pusher mechanism in accordance with this embodiment. As shown the storage assembly comprises a number of compartments 61, the height of which is defined by upper and lower shelves 60*a*, 60*b*. Each shelf has a length L which is sufficient to carry a number of cartridges represented by the letter C on shelf 60*b*. Each shelf is provided with a pair of rails 62, 63 which extend from the back end 64 of the shelf 60*b* to the front end 65.

As shown in FIG. 9, the rails 62, 63 are parallel and at their front ends are provided with pulling hooks 66 which are shaped to engage with corresponding lugs of the stacker 67 (not shown) but which can be located in any convenient location on the cartridge stacker. Each of the rails is connected to the end 64 of the shelf through springs 68 which bias the rails so that they are returned to their original position after the stacker lugs 67 disengage the hooks 66.

A pusher 69 is slideably mounted on the rails 62, 63 and when the shelf 60*b* is full, is located close to the end 64.

The pusher 69 comprises a panel having a vertically upwardly extending wall which is bent forward so as to provide an overhanging portion 70. The panel 69 is mounted on two guide blocks 71, 72 which are disposed for slideable movement on the rail 62, 63.

Each of the guide blocks 71, 72 are provided with locking pins 73, 74 respectively which enable the guide blocks to be fixed from relative movement with respect to the rail 62, 63.

Operation of the shelf pusher mechanism will now be described with reference to a dispensing and receiving operation.

In a dispensing operation, the shelves are normally filled with new cartridges B and the pusher 70 is located at the rear end 64 of each shelf.

When a stacker is moved to a location adjacent the front end 65 of one of the shelves, the stacker lugs 67 are positioned so that they lie directly underneath the hooks 66. A slight upward movement of the stacker then ensures that the hooks 66 engage the lugs 67.

Alternatively, the hooks 66 may be mounted on pivotable connections with the rails so that when the lugs 67 are moved forward, the hooks ride over them and then latch into engagement. At this time, the conveyor belts of the stacker have moved the cartridge pusher 28 to the front of the stacker to enable the hooks 66 and lugs 67 to engage. The microprocessor controller then is operated to move the conveyor belts 27*a*, 27*b* so that the rails 62, 63 are pulled along by the lugs 67 as they are withdrawn. At the same time, the pusher 70 is pulled along, as well as all the cartridges in front of it. When the cartridge pusher is again located at the rear of the stacker, the front most cartridge on rail 62, 63 is located over the stacker.

Once this occurs, the lugs 67 are disengaged from the hook 66 either automatically or through control by the microprocessor controller. Once this occurs, the rails 62, 63 are retracted by springs 68.

At this time however, the pusher 70 and its guide blocks 71, 72 are disengaged from the rails 62, 63 so that their legs 75, 76 are resting on the base of the shelf. When this occurs, retraction of the rail 62, 63 does not simultaneously cause retraction of the pusher. Instead, the pusher 70 is maintained in position and consequently the front most cartridge is dropped onto the stacker as the rails slide from beneath it.

In an alternative arrangement, the rails or base adjacent to the rails is provided with ratchets which only permit movement of the pusher in a forward direction. These ratchets can be controlled by the microprocessor so that once the pusher 70 has reached the front end 65, all the ratchets can be withdrawn to allow the pusher 70 to be returned to the back end 64 of the shelf. In addition, the pusher 70 may be provided with a motor (not shown) which moves it forward so as to push a cartridge onto the stacker and provide it with some breaking mechanism to prevent it returning to the rear end 64 of the shelf whenever the rails 62, 63 are retracted.

The motor can be controlled by the microprocessor controller and senses 77 can be provided on each rail to indicate when the pusher 70 has moved a distance corresponding to a storage area for one cartridge.

Once one of the cartridges B have been removed from the shelf 60*b*, the stacker may return to this shelf and be loaded with another cartridge by a similar method as previously described.

Once a shelf is empty, that shelf can be used for storage of used cartridges in a manner which will now be described.

Once a cartridge has been moved from the draw 15 to the stacker, the stacker is then moved down to a position adjacent to the shelf, for example, 60*b* and the conveyors are operated to move the cartridge forward so that it is eventually pushed off the stacker onto the front of the shelf 60*b*.

In a subsequent operation, another cartridge which is ready to be loaded on the same shelf will be moved forward and in doing so will push the cartridge, already there, forward as well so that eventually two cartridges are provided on the shelf in close proximity to each other.

The same procedure can then be followed until the compartment is full. Alternatively, the pusher could be replaced by a vehicle which moves each cartridge individually from the front to the back of the compartment and vice-versa. Such a vehicle would be movable parallel to the guides and would have sections which are movable upwardly and downwardly to engage and disengage each cartridge, thus enabling each cartridge to be moved to a desired location in each compartment.

Alternatively, the vehicle can be in the form of a carriage or platform which is arranged to pick up a cartridge and move it to its intended destinations, where it is then released. The platform can be raised to pick up a cartridge and lowered beneath the rails to release the cartridge. The platform may also be movable in any direction along mutually perpendicular axes lying in the plane of the base of the compartment. The platform would be provided with upwardly directed abutments to prevent the cartridge from falling off.

Figure 11:
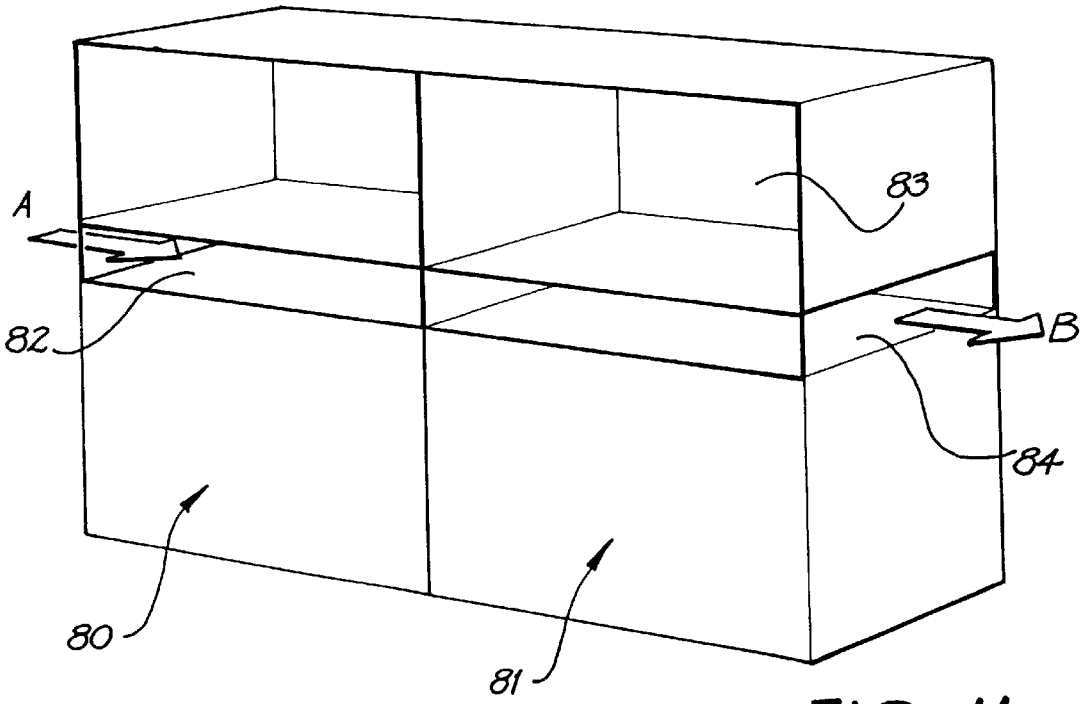
FIG. 11 is an angled view of an apparatus according to a further embodiment of the present invention.

Referring to FIG. 11, a schematic angled view of an apparatus for receiving and dispensing articles, according to a further embodiment, is shown. In this embodiment, the apparatus comprises a used storage area 80 and a new storage area 81 is the form of two rectangular containers arranged side by side.

The used storage area comprises a receiving area 82 which is adjacent a dispensing zone 83 of the new storage area. The used storage area 80 is provided with a compartment below the receiving area which is arranged to store used cartridges. The new storage area 81 may be provided with a stack of new cartridges above the dispensing zone 83 and/or below the dispensing area 83.

Typically, a cartridge is inserted into the receiving area 82 in the direction A and when such a cartridge is inserted, this pushes a pushing device (not shown) which inturn pushes a new cartridge located in the dispensing zone 83 through the outlet 84 in the direction indicated by the arrow B.

It is preferred that the pusher is spring loaded so that when it is pushed into the dispensing zone, it is returned to its original position in the receiving area once the used cartridge has been removed to the storage compartment.

Typically, when the used cartridge is fully inserted into the receiving area, sensors indicate this and a base panel of the receiving area opens to allow the used cartridge to be either dropped or moved into the storage compartment. After this occurs, the base panel closes again and the pusher device returns to its original position ready to receive another used cartridge.

In the new storage area, when a new cartridge has been dispensed, either a cartridge at the bottom of the stack above the dispensing zone is dropped/moved into the dispensing zone or a cartridge at the top of the stack below the dispensing zone is moved upwardly and placed in the dispensing zone.

Alternative versions to the above described apparatus are also envisaged in which manual insertion of a used cartridge into the receiving area produces a mechanical operation of components within the apparatus which produces dispensing of a new cartridge from the dispensing zone. Accordingly, in a preferred embodiment of this version of the apparatus, it is desired that a new cartridge is dispensed by using the force with which a used article is inserted into the receiving area. Accordingly, it is envisaged that a used cartridge be inserted into the receiving area in a manner whereby at the same time the act of inserting the used cartridge pushes a new cartridge out of the dispensing zone.

It is also possible for the receiving area to be the same as the dispensing zone so that new cartridges are stacked above the receiving area/dispensing zone and used cartridges are stored below it. Thus, the act of inserting a used cartridge involves pushing out a new article from the receiving area/dispensing zone. The dropping of the used cartridge to the storage compartment below and the movement of a new cartridge from the bottom of the new cartridge stack into the receiving area/dispensing zone.

According to an alternative embodiment, a storage only system is provided. A mechanical or electronic counter is arranged to monitor the storage of items to govern the dispensing of replacement items manually ie on the basis of a pre-determined ratio of used items lodged for storage.

According to another embodiment of the present invention it is preferred that the apparatus for storing used articles and dispensing new articles be combined with an apparatus for dispensing a reward. In this way, a person is then encouraged to insert a used cartridge into an apparatus for storing/dispensing on the premise that such a deposition will result in the dispensing of a reward.

Figure 12:
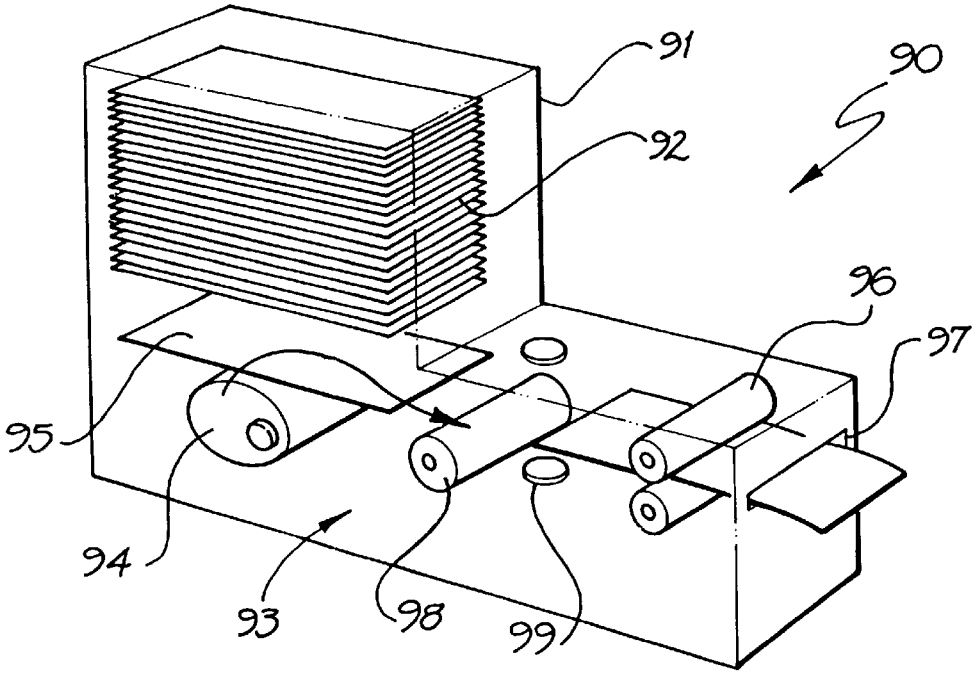
FIG. 12 is an angled view of a reward dispensing apparatus according to an embodiment of the present invention.

Such a reward dispenser could be in the form shown in FIG. 12. Thus, the reward dispenser 90 would be connected with or would be part of the apparatus for storing used articles and dispensing new articles. The reward dispenser 90 would comprise a compartment 91 full of stacked tickets 92. The stack of tickets 92 would be located above a dispensing mechanism 93 comprising a series of rollers, motors and levers.

When the reward dispenser receives instructions from a microprocessor of the apparatus for storing/dispensing, or from an appropriate sensor, a ticket at the bottom of the stack of tickets 92 is released onto a cam shaped roller 94. The cam shaped roller lifts and moves the ticket 95 to an area comprising dispensing rollers 96. The dispensing rollers then move the ticket 95 so that it protrudes from the outlet 97 so that a person can withdraw it.

According to an option of the reward dispenser, the act of withdrawing a ticket can simultaneously release the bottom most ticket from the stack of tickets 92 and activate the cam roller 94 so that the lower most ticket is moved to a waiting area by waiting roller 98 which moves the ticket until it is detected by sensor 99 (which may be in the form of an optical sensor or microswitch) which then turns off the waiting roller 98 thus leaving the ticket in an area adjacent the area for dispensing so that when the reward dispenser is instructed to dispense a new ticket, the waiting roller and any other rollers may be activated to move the ticket to the rollers 96 in the dispensing area.

A variation on the reward system is to have the apparatus record the user ID and quantity of each type of article lodged for storage, to allow for electronic processing and notification of user rewards.

Other versions of reward dispensers are also envisaged which permit the dispensing of items other than tickets (such as cards, tokens, etc. Such tickets could include some type of credit which the recipient could then cash in.

Figure 13:
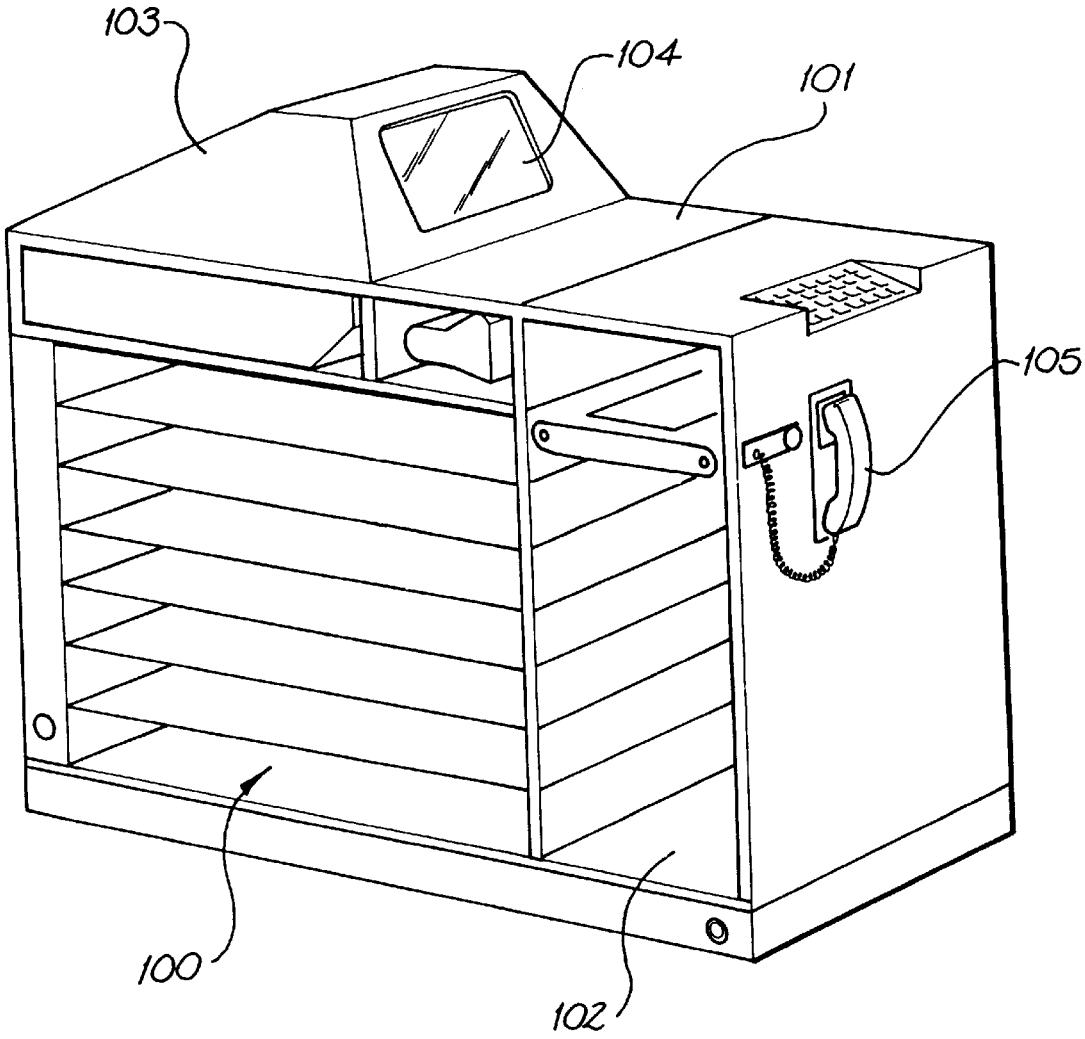
FIG. 13 is an angled view of an apparatus according to an embodiment of the present invention which may employ the shelf pusher and compartment of FIG. 10.

FIG. 13 shows an example of a complete of an apparatus for storing used articles and dispensing new articles which incorporates a computer control unit and which may have storage compartment assembly and transport means as in previous figures. The apparatus is effectively the same as that shown in FIG. 3 but incorporates a display screen which provides instructions on how to operate the apparatus and may also permit information to be displayed on the number of used articles, the number of new articles, the number of credits which a user would have accrued through use of the apparatus, etc. The display could also include a direct means of communication with a central control area and a telephone may be provided to permit audio communication.

The apparatus, as with that shown in FIG. 1, comprises a storage compartment assembly 100, a drawer compartment 101, an elevator compartment 102, and a computer control unit 103 including a video display 104. A telephone 105 may also be provided and although shown attached to the elevator compartment may be provided in any other location and the overall configuration of the apparatus can be changed so that the various components are located in different locations, including a similar system designed to be located against a wall and wherein articles are loaded from the side.

Figures 14, 17, 18:
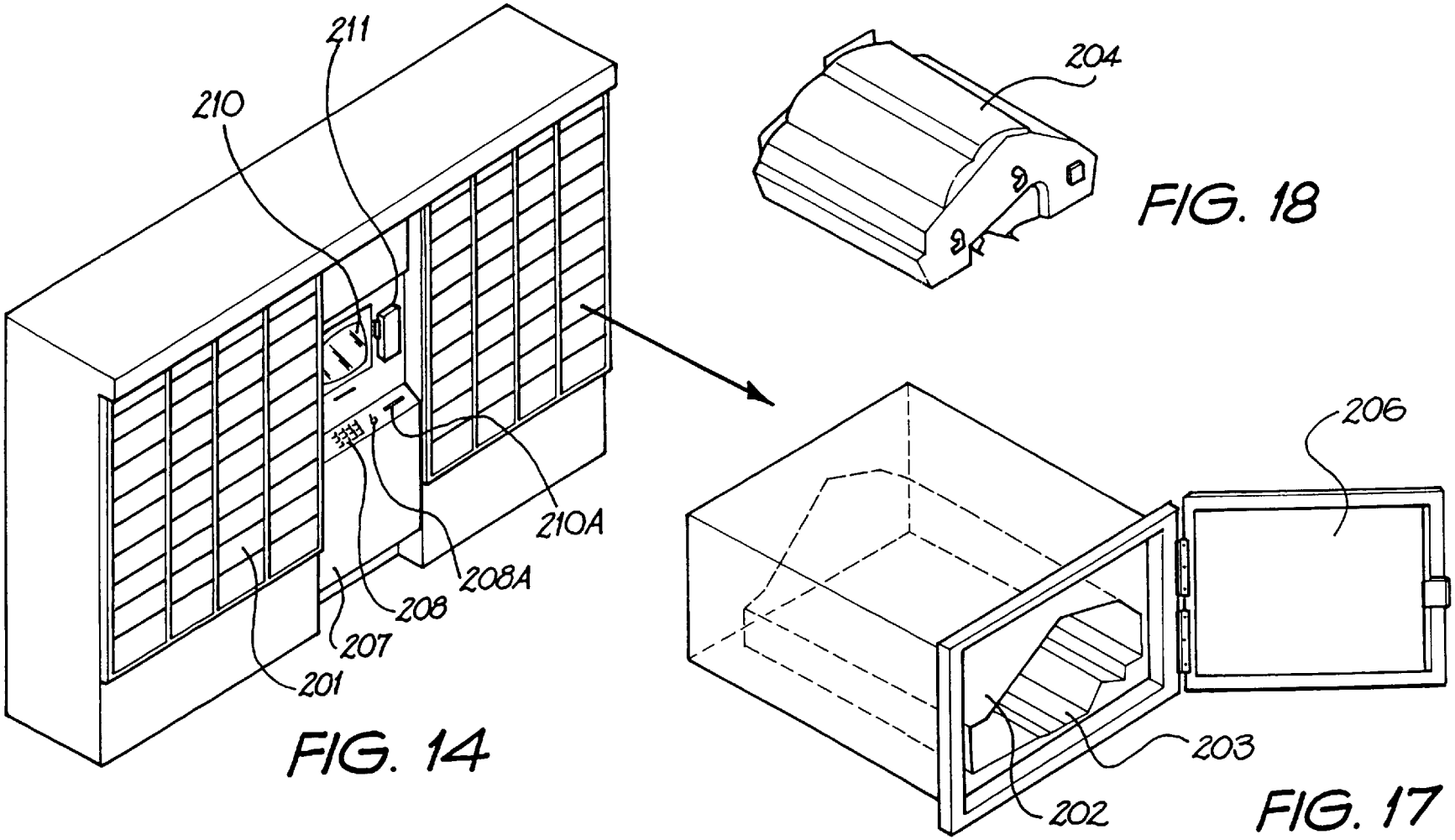
FIG. 14 is a perspective view from above, the front and one side of an apparatus in accordance with a further embodiment of the present invention.
FIG. 17 is a perspective view of a storage compartment of the apparatus of FIG. 14, showing the walls of the compartment in ghost outline to reveal the compartment insert.
FIG. 18 is a perspective view of a toner cartridge which the embodiment of FIG. 14 is arranged to store and dispense.
Figure 15:
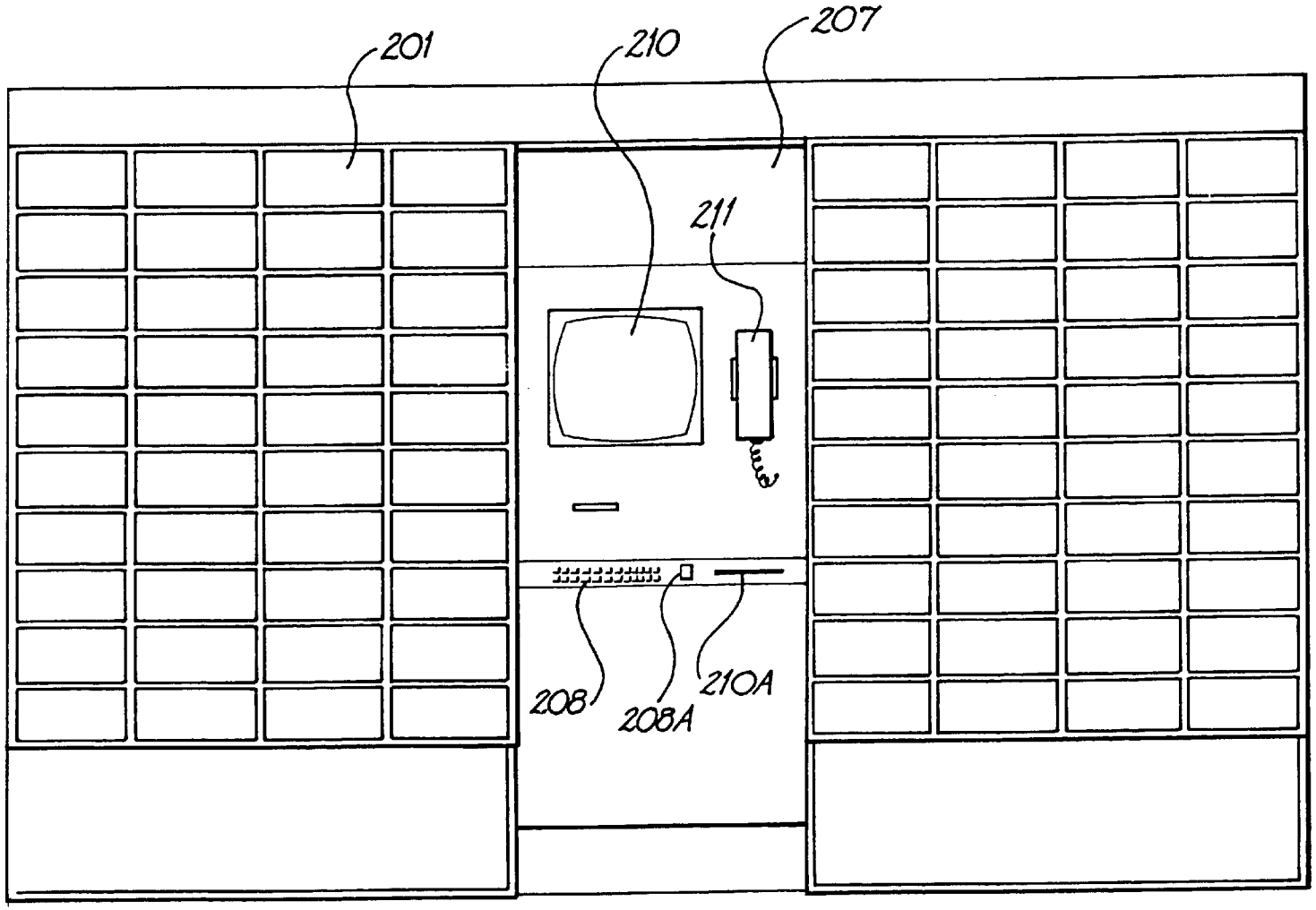
FIG. 15 is a front view of the apparatus of FIG. 14.
Figure 16:
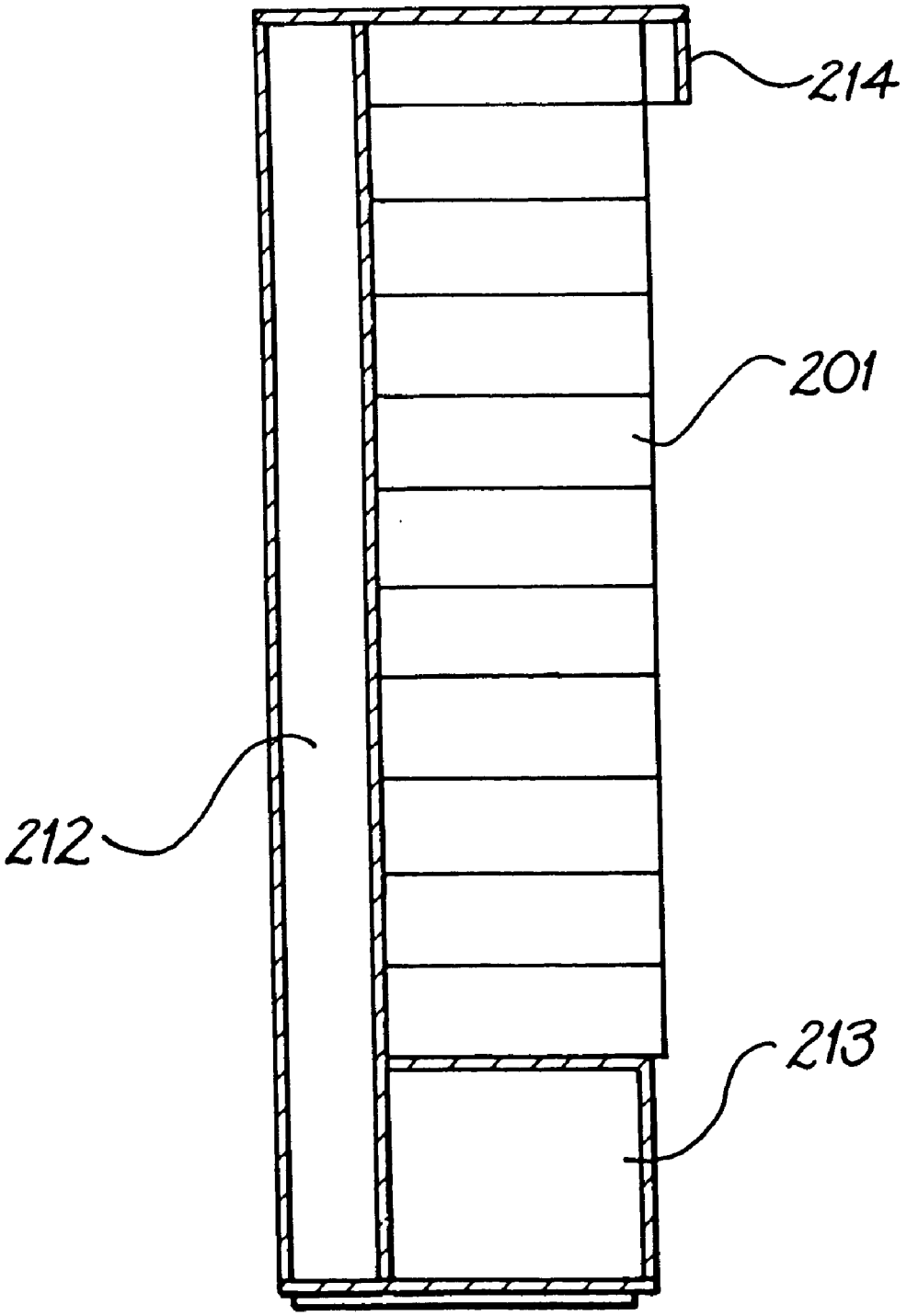
FIG. 16 is a cross-section along line AA of FIG. 15.

A further embodiment of the present invention will now be described with reference to FIGS. 14 through 19. The storage space in this embodiment comprises a plurality of storage locations 201, each location being arranged to accommodate a single toner cartridge, printer cartridge or the like. An example of storage location 201 is shown in isolation 17, FIG. 17. Location 201 contains a precast core which is physically shaped to accommodate an article, eg a printer cartridge. The core is designated by reference numeral 202. The shape of the core 202 is such that it will only receive a cartridge having the particular desired profile, ie the profile 203 of the core is designed to conform with the profile of a cartridge. A printer cartridge which will fit into the core of the storage compartment 201 of FIG. 17 is designated by reference numeral 204 in FIG. 18. Various shape cores 202 may be employed in the compartments 201, depending upon the shape of the complex article they are designed to receive. In some applications, different compartments 201 may have differently shaped cores, for receipt of different types of recyclable complex articles, such as different types of toner cartridges, printer cartridges, etc.

A solenoid/sensing mechanism at the back of the compartment 201, illustrated schematically and designated by reference numeral 205 detects when an article has been placed in the compartment. The solenoid 205 has a projecting portion arranged to abut an article which is placed in the compartment 201. As long as the article is of the correct shape, a user will be able to push the article to the back of the compartment 201 to actuate the solenoid 205. An alternative arrangement is the application of a door latch solenoid to sense the lodgement of a recyclable article. A mechanism attached from the door latch solenoid to the rear of the compartment can be used to partially eject the item from the compartment. Actuation of this mechanism would also indicate that a cartridge had been placed within the compartment.

The compartment 201 is provided with a lockable door 206 which is controlled by a control means 600. Solenoid actuated latches or other means may be provided for control of the door 206.

Figure 29:
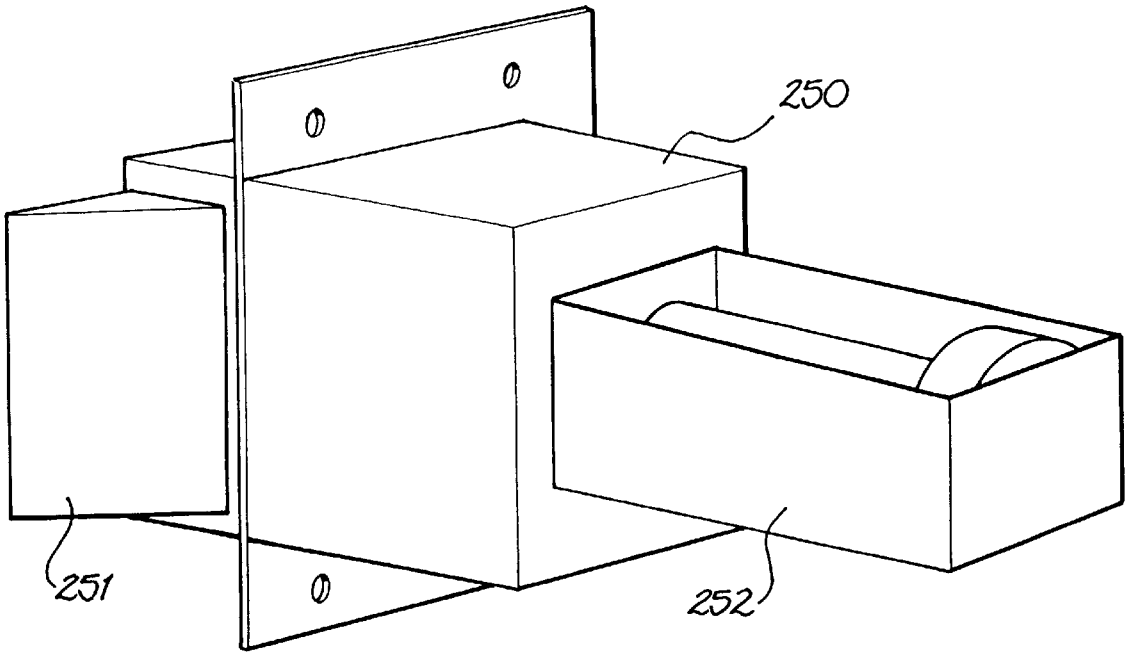
FIG. 29 is a perspective view showing a catch mechanism for use with an embodiment of the present invention.
Figure 30:
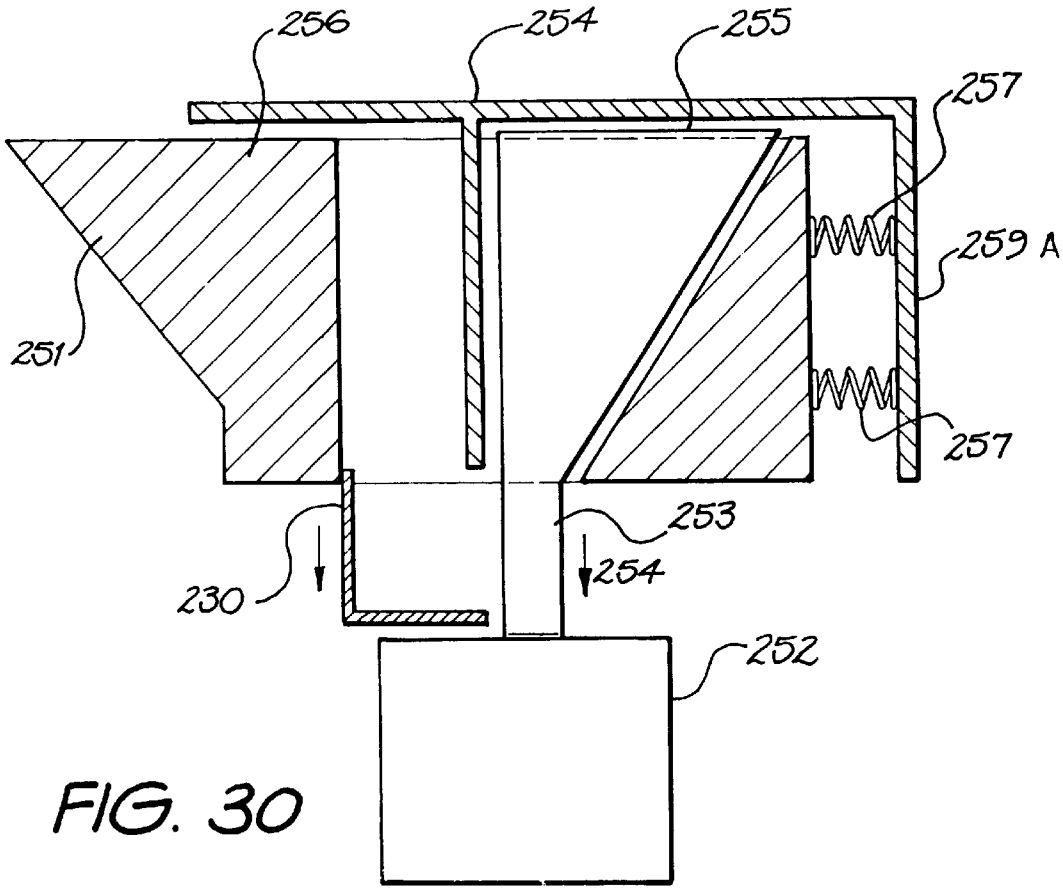
FIG. 30 is a sectional view from above of a catch for FIG. 29 showing operating detail.
Figure 31:
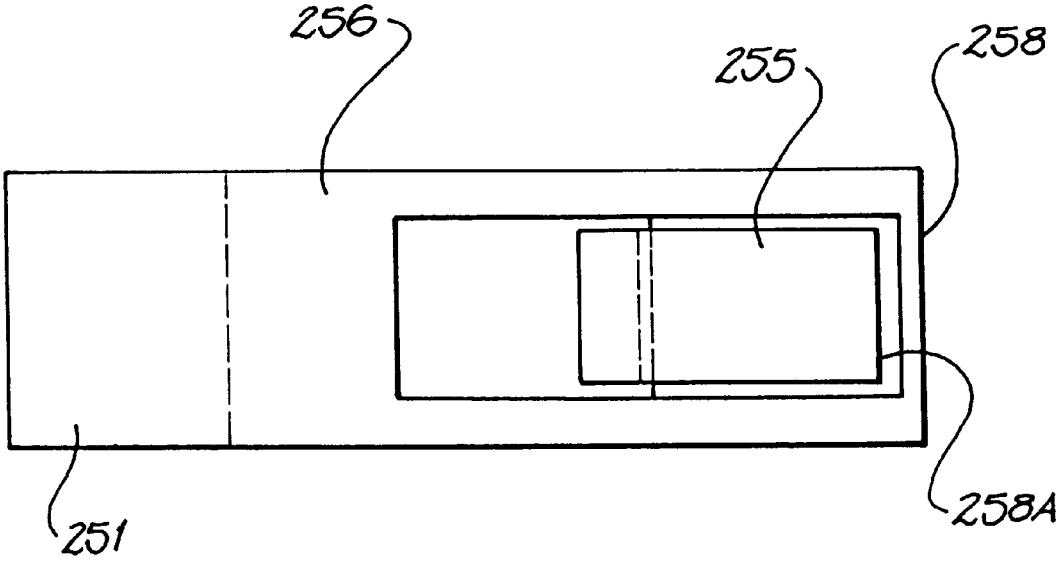
FIG. 31 is a view from the front of the catch mechanism of FIG. 30.

A suitable latch mechanism for use on the lockable door 206 of compartment 201 is illustrated in FIGS. 29 and 30. The mechanism comprises a latch seat 250 which is seated within the door frame, in operation, and a projecting catch 251 which will mate with a corresponding slot (not shown) in the door 206. The latch mechanism is operated by means of a solenoid arrangement 252 which is in turn operated by the control means of the apparatus. The solenoid 252 comprises a portion 253 moveable in the direction of the arrow 254 (into the door frame) on actuation of the solenoid mechanism 252. Portion 253 is connected to a wedge member 255 which moves inwards on actuation of the solenoid mechanism 252. The catch 251 is integral with a slide 256 which is moveable from left to right as shown in the drawings on actuation of the solenoid mechanism 252. Motion of the wedge 252 inwards in the direction of arrow 254 causes the slide 256 to move from the left to the right against the action of springs 257. FIG. 31 illustrates the slide 256 from a top view without the rest of the mechanism. The wedge 255 moves within slot 258. A frame member 259 maintains the wedge hard up against surface 258 A of slot 258, by virtue of being integral with the backplate 259 A, which is stationary in operation.

On actuation of the solenoid mechanism 252, therefore, the catch 251 moves to the right away from the slot in the door 206 to enable the door to be opened. To prevent the door being opened illegally by wedging an object into the gap between the door and the mechanism, a projecting portion projecting from member 253 abuts the slide 256 to prevent the portionless solenoid mechanism 252 being actuated. The projecting portion has reference numeral 230.

As discussed above, the solenoid mechanism 252 may also be connected to an appropriate mechanism for ejecting a cartridge at least part way once the door is opened.

The rest of the apparatus of FIGS. 13 through 19 will now be described.

The apparatus also comprises a control means 600 positioned behind panel 207. A keypad 208, magnetic card reader 209, visual display unit 210 and handset 211 are provided for user interaction with the apparatus. See the description in relation to FIGS. 1 and 2 for overall operation. A barcode reader 208A and printer 210A are also provided.

The apparatus is provided with space 212 and 213 containing electrical cables and solenoid machinery. Lights 214 are also provided for illumination of the apparatus.

In operation, if a user of the apparatus wishes to deposit a used cartridge for recycling, he indicates to the control means 600 via keypad 208 that this is his wish (see operating description in relation to FIGS. 1 and 2). The control means 600 can actuate the latch of an empty compartment 201 to allow the compartment door to be opened. The door 206 may spring open or as the compartments are numbered, VDU 210 may indicate which compartment the user should approach. The control means 600 "knows" if a compartment is empty or full depending upon the state of the solenoid 205 and/or information stored in its database, as will be explained later.

The user then inserts the article in the core 203 of the compartment 201. If the article does not fit into the core profile 203, ie if it is of a different shape to that designated by the core profile, it will not go into profile 203 acts as a "determining means" to determine whether the article is of an approved type to go into the compartment 201. If it will not go into the core, it is rejected by virtue of the fact that the person cannot physically push the article into the core. Supplementary sensor means may be provided to assist the determination of the article for approval. Such sensors may be located in the area marked 212 so as to be free from dust and dirt generated by the recyclable article, but are activatable by a sensor being moved at the rear of the compartment by lodgement of the recyclable article. For example, optical sensors could be provided to detect other features of the article. If the article is small enough to go into the core 202 without impinging upon the core profile 203, such a supplementary sensor may provide an additional guard and warn the control means 600 that the apparatus is being improperly used.

As an added deterrent to improper use, even if the user manages to insert an improper article without being prevented by the core shape or by any supplementary sensors, because the compartments 201 are separately numbered and because the user has identified himself to the control means 600, the servicing agent unloading the compartments 201 would immediately recognise that improper use had occurred and would be able to connect that improper use with a particular user.

If a user wishes to obtain a new article, he will indicate this by use of the keypad 208, a door will be indicated to him or will automatically open, containing a new or recycled article. Again refer to description in relation to FIGS. 1 and 2 for circumstances where the user would be denied the new article because, for example, he has not deposited a sufficient number of used articles.

The solenoid sensing mechanism 205 acts as a detection means to detect when an article has been placed in a compartment 201. The solenoid comprises a projecting portion which projects into the core 202. On a user pressing home an article in the core 202 the projecting portion of the solenoid 205 is pushed backwards, actuating the solenoid (and activating any supplementary sensors). This is recorded by the control means, which therefore knows that the compartment 201 is occupied. On dispensing of an article, the solenoid 205 is actuated by the control means such that the projecting portion is pushed out automatically when the door is opened, causing an article to be pushed partially out of the core 202. The article is removed and the control means therefore knows that the compartment 201 is empty because the projecting portion is in the outward position and/or because the transaction is recorded in the control system database.

Rather than having a separate solenoid mechanism 205 at the back of the compartment 201, the solenoid mechanism of a latch mechanism (such as latch mechanism shown in FIGS. 29 onwards) may be mechanically connected to a projecting portion at the back of the compartment 201 to provide the function discussed above.

As discussed above, the apparatus need not be designed for one particular article. Different cores could be provided in different compartments for different complex articles.

Figure 19:
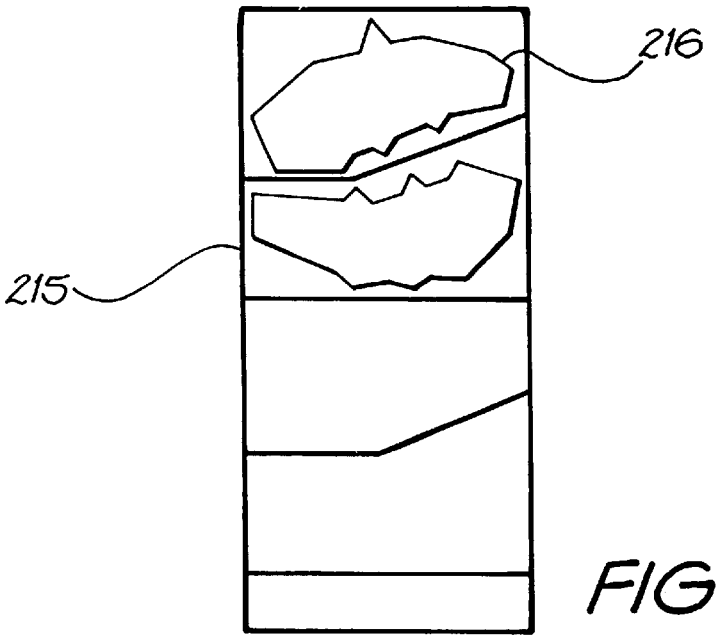
FIG. 19 is a schematic view showing a variation on storage compartments for use with the embodiment of FIG. 14.

FIG. 19 is a sectional view through an alternative storage arrangement for the embodiment of FIGS. 14 to 18. Here the storage compartments are specifically designed to make the best effective use of space, in relation to the shape of the articles they contain. The storage compartments 215 contain cores 216 specially shaped for the particular article and arranged in different attitudes from an adjacent core in order to make the best use of the space.

Figure 20:
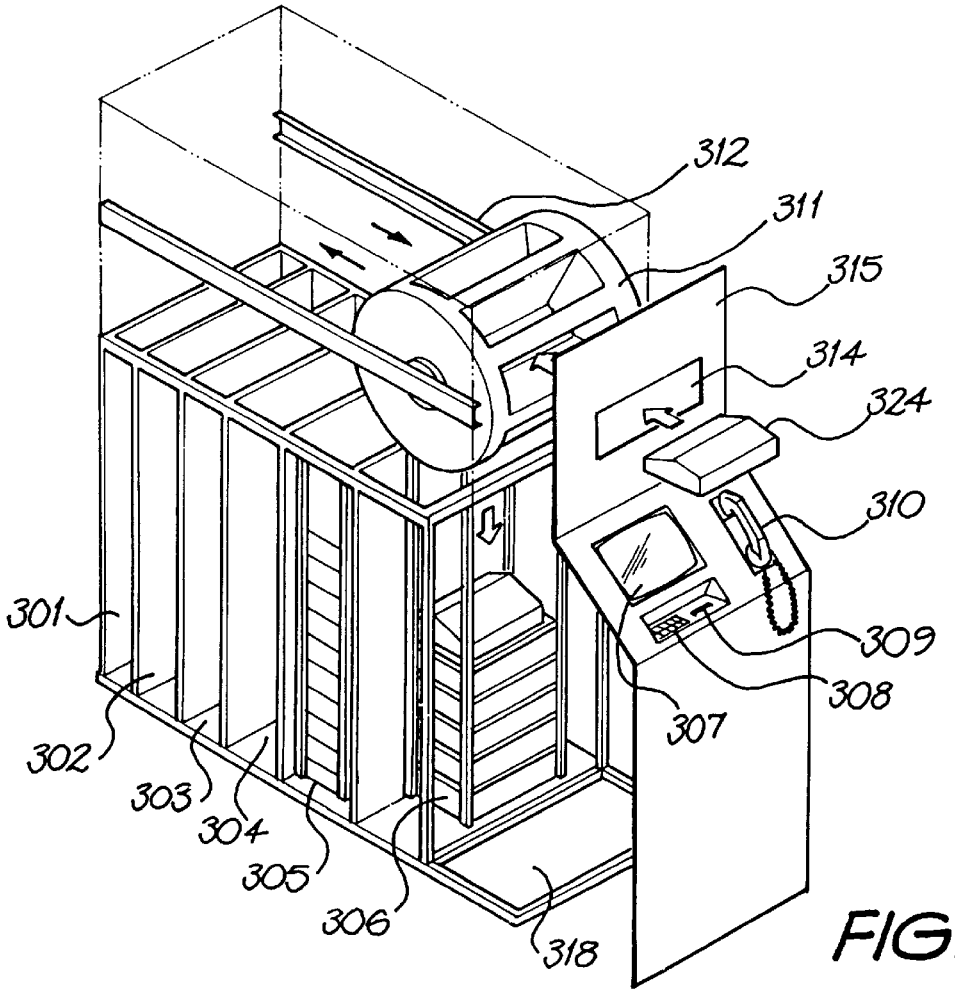
FIG. 20 is a perspective view from above and one side of a further embodiment of the present invention, with cover removed to show internal working details schematically.
Figure 21:
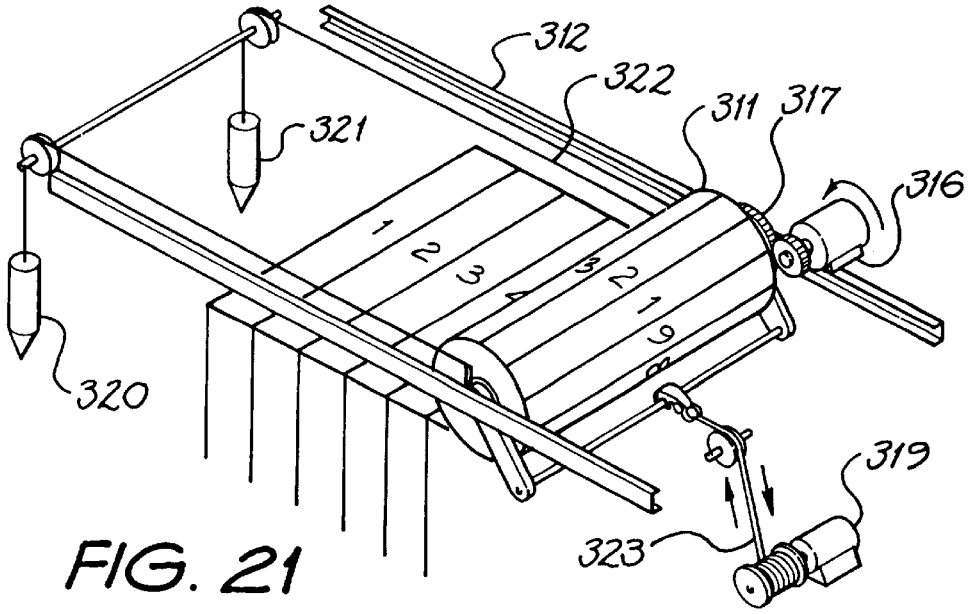
FIG. 21 is a schematic illustration to show operation of a receptacle and transport means for the embodiment of FIG. 20.

An alternative embodiment to an apparatus in accordance with the present invention is shown in FIGS. 20 and 21.

Figure 22:
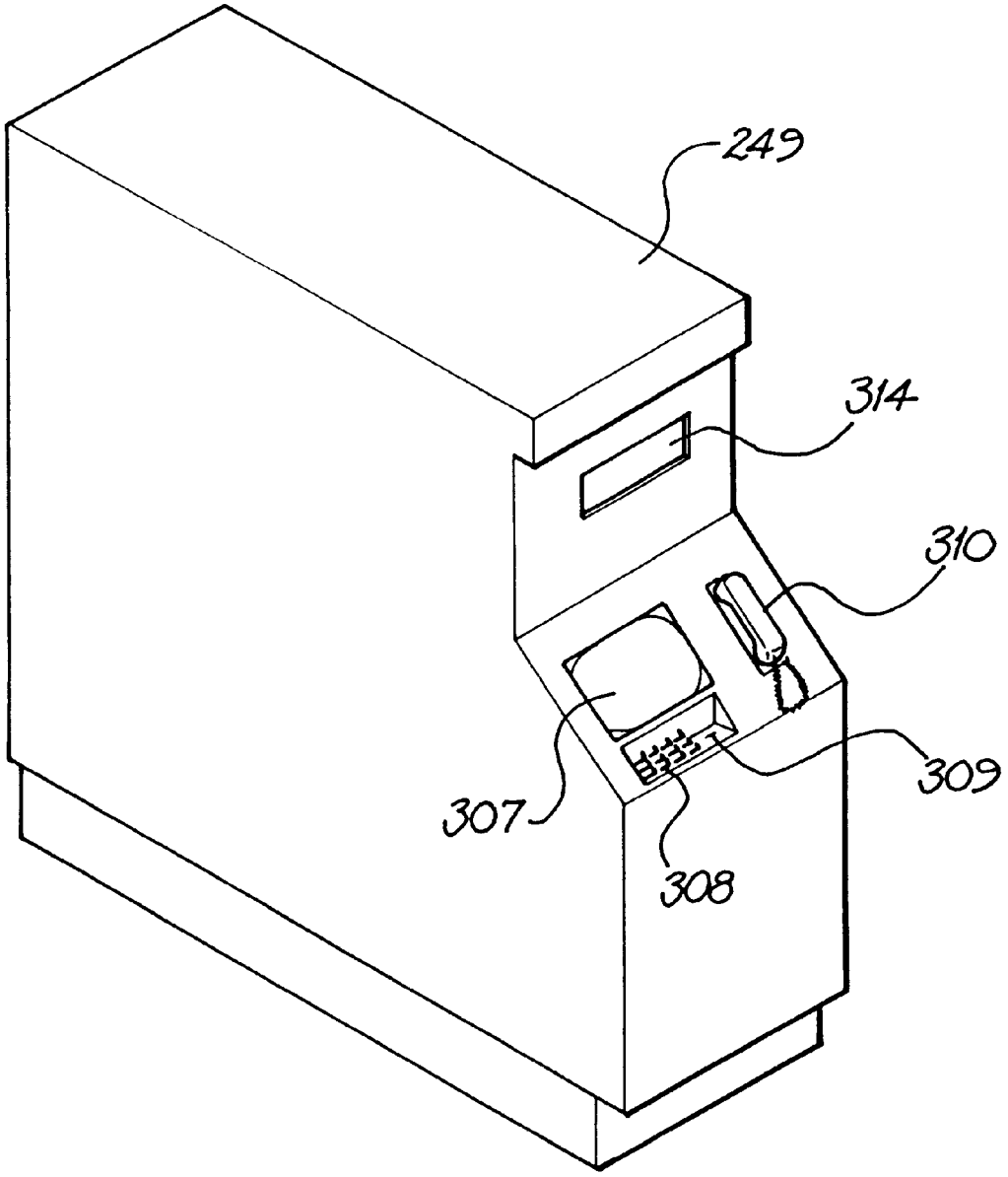
FIG. 22 is a perspective view from above and one side of the embodiment of FIGS. 20 and 21, with cover in place.

This embodiment is designed to store a number of different types or brands of complex articles in separate stacks 301 through to 306. Note that the apparatus is shown with the cover removed whereas in operation the cover would be in place to prevent access by unauthorised persons. FIG. 22 shows the apparatus with cover 249 in place.

As well as the stacks for the articles 301 to 306, the apparatus comprises a visual display unit 307, a user keyboard 308, a magnetic card reader 309 and a telephone handset 311. See the description in relation to FIGS. 1 and 2 for a description of general operation. A receptacle in the form of cylinder 311 is rotatable and also moveable in a longitudinal direction along the rail 312 over open tops of the columns 301 to 306. Apertures 313 are provided circumferentially in the cylinder 311. Each aperture is of a different shape, the different shapes conforming to different types of cartridges intended for storage in the apparatus. A cartridge entry slot 314 is provided in a front panel 315 of the apparatus.

Referring to FIG. 21, which is a schematic diagram of operating parts of the cylinder 313 motive mechanism, it will be seen that the apparatus is provided with a first electric motor 316 for rotation of cylinder 313 via gear 317 under the control of the control means 600 (control means 600 is stored in space 318). A second electric motor 319 is provided for lateral movement of cylinder 313 along rails 312 in concert with hang-weights 320 to 321. Steel cables 322 and 323 are provided to transmit the motive power of the motor 319 and hang-weights 320 to 321.

When a user wishes to insert a cartridge 324, he indicates by way of the keypad which type of cartridge (ie which brand, or which type) he wishes to deposit. The control means 600 then controls the electric motor 316 to rotate cylinder 311 till the correct aperture 313 is presented to cartridge entry slot 314. The user then places the cartridge 324 in the aperture 313. If the shape of the article is not correct it will not go into shape of the article is not correct it will not go into the aperture 313 and termination procedure occurs as in FIG. 2. Similar to the embodiment of FIGS. 14 to 18, supplementary sensors may be provided for identifying the article.

If the article is of the correct type, motors 319 and 316 will be actuated to deposit the used article in the correct column 301 through 306.

The apparatus of FIGS. 20 and 21 may be designed for deposit only. If it is also designed for dispensing at least some of the columns 301 through 306 will be designed with a lift actuator mechanism for lifting the column in response to an indication from a user that he requires a new article of the type stored in the columns 301 to 306. A picker in cylinder 311 would then be rotated to pick off the top item from the column and bring it to the cartridge entry slot 314.

Figure 23:
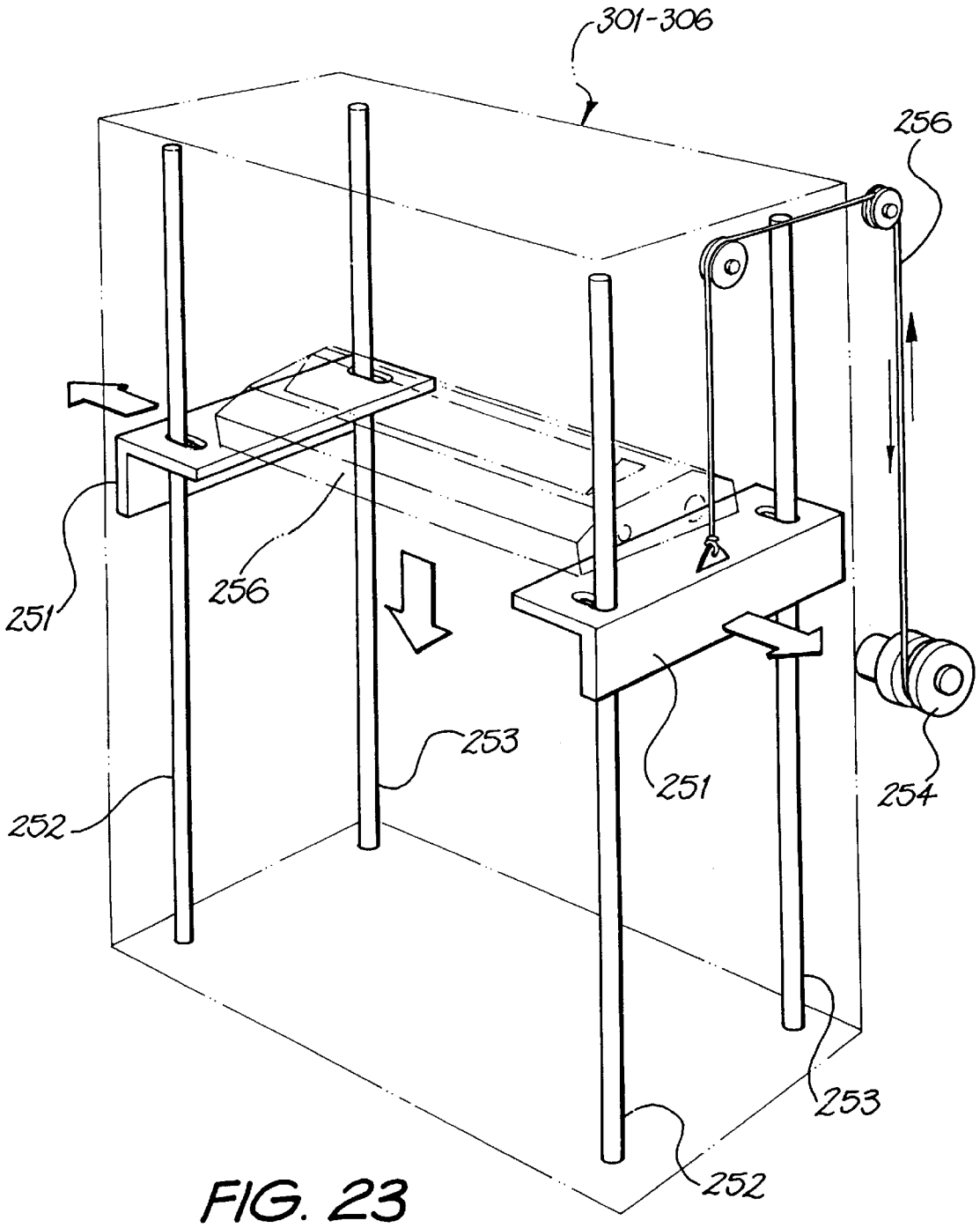
FIG. 23 is a detail showing a lift mechanism for use with the embodiment of FIG. 20.
Figure 25:
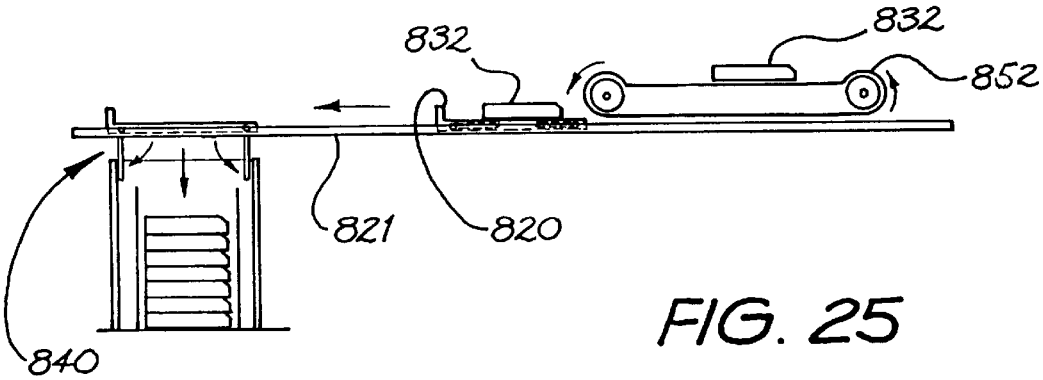
FIG. 25 is a detail showing a cartridge moving mechanism of the embodiment of FIG. 24.

An example lift mechanism which would be suitable for this function is illustrated in FIG. 23. The illustration represents the inside of a column 301 to 306. This mechanism comprises lift platform members 251 slideable vertically on supports 252, 253. The platform members 251 are actuated by means of an electric motor 254 connected to the platform members 251 by a steel wire. The motor 254 would be controlled by control means in accordance with operation of the apparatus in order to lift a cartridge 256 to enable a cartridge to be dispensed. A similar motor 254 and 255 arrangement may be provided for the other lift platform 251, but is not shown.

Figure 24:
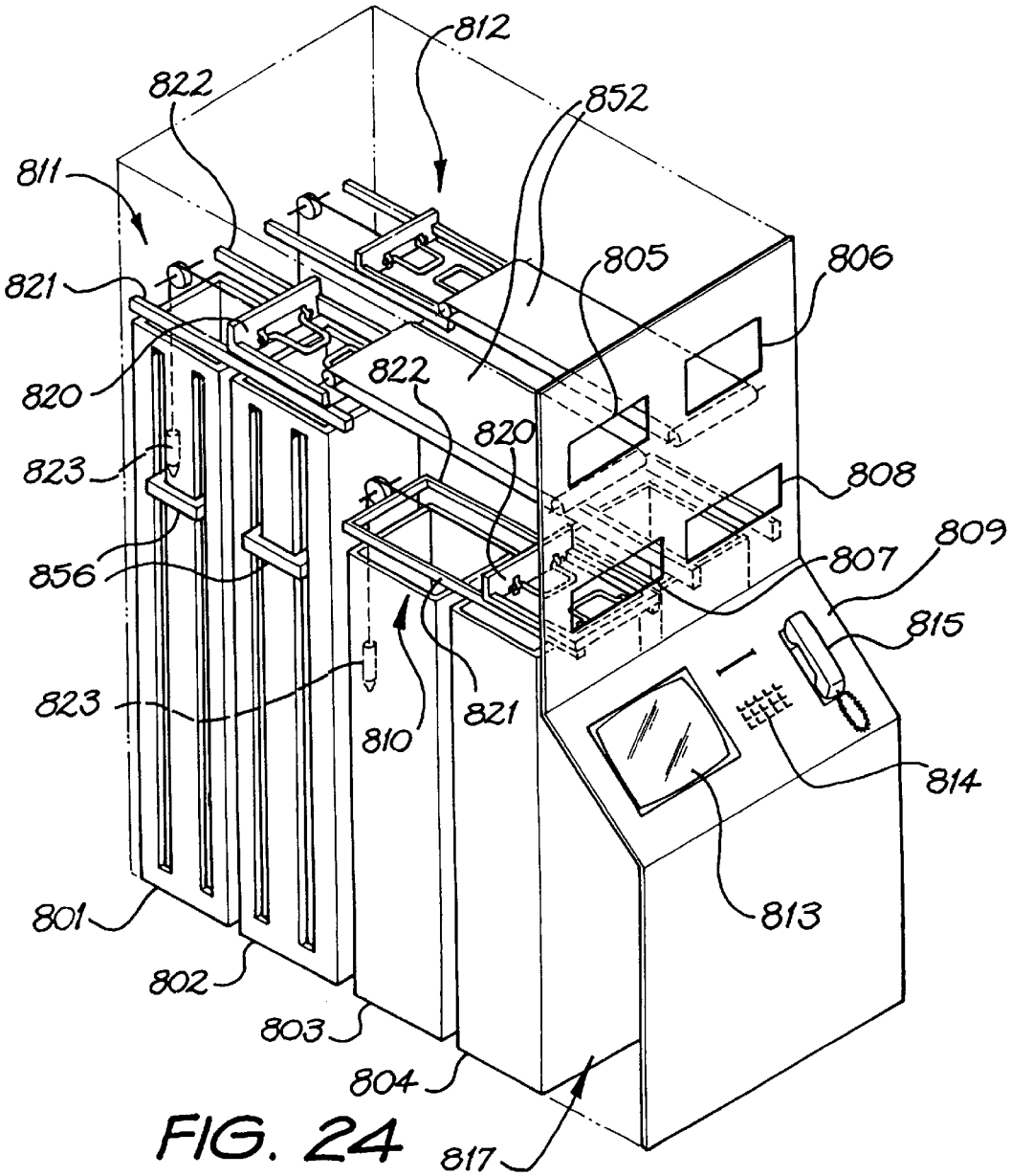
FIG. 24 is a perspective view from above and one side of a further embodiment of the present invention, with cover removed to show internal working details schematically.
Figure 26:
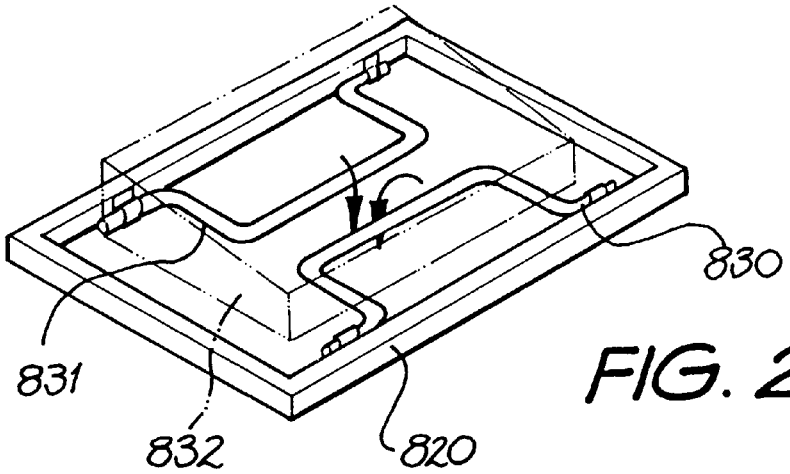
FIG. 26 is a detail showing a cartridge receiving mechanism of the embodiment of FIG. 24.

A further embodiment of the present invention is illustrated in FIGS. 24 through 27. FIG. 24 shows a view of the apparatus with the cover removed. The apparatus comprises a number of stacks 801 through 804 for the storage of used articles for recycling and replacement articles for dispensing. Four more stacks (not shown) are disposed symmetrically on the other side of the apparatus. Four slots 804 through 808 are disposed in the front panel 809 of the apparatus. Each slot may receive or dispense an article. The slots may be of different shapes and sizes to receive different articles. Top slots 804 and 806 are arranged to dispense/store articles in rear columns 801, 802 and lower slots 807 and 808 are disposed to dispense/store articles in front columns 803, 804. Cartridge moving mechanisms 810, 811 are provided to move cartridges to/from slots 807, 808, 805, 806. The apparatus is also provided with a display 813, keyboard 814, telephone handset 815, magnetic card reader 816 and a control data processor 817 (not shown). Sensor means may be provided in relation to each slot 805 through 810 to determine whether or not the articles inserted therein are the correct type to be accepted (see previous description in relation to other embodiments). The sensors may be mechanical-shape or optical-shape sensors.

The cartridge transport mechanism 810 (see FIG. 26) comprises a frame 820 which is moveable on slides 821, 822. This is moved over either column 803, 804, as desired. Hang-weight 823 and an electric motor (not shown) operate under the control of control means 817 to cause motion of frame 820. Frame 820 mounts pivotable supports 830, 831. These supports are pivotable under operation of the control means 817 by use of electric motors (not shown) or application of an appropriate mechanical arrangement (not shown). In the position shown in the drawings, pivotable supports 830, 831 serve to support a cartridge 832 placed on frame 820. When the frame 820 has been moved over the appropriate column, the pivoting supports 830, 831 are released and pivoted to a downward position (reference numeral 840, FIG. 25) to release the cartridge 832 to enable it to fall into a column 801 through 804. Operation to dispense a cartridge is the opposite to depositing a cartridge. Cartridge lifts 850, 851 may be provided in some columns 801, 802 to enable dispensing of cartridges. The cartridge lifts may have the same structure as described in relation to FIG. 23.

Figure 27:
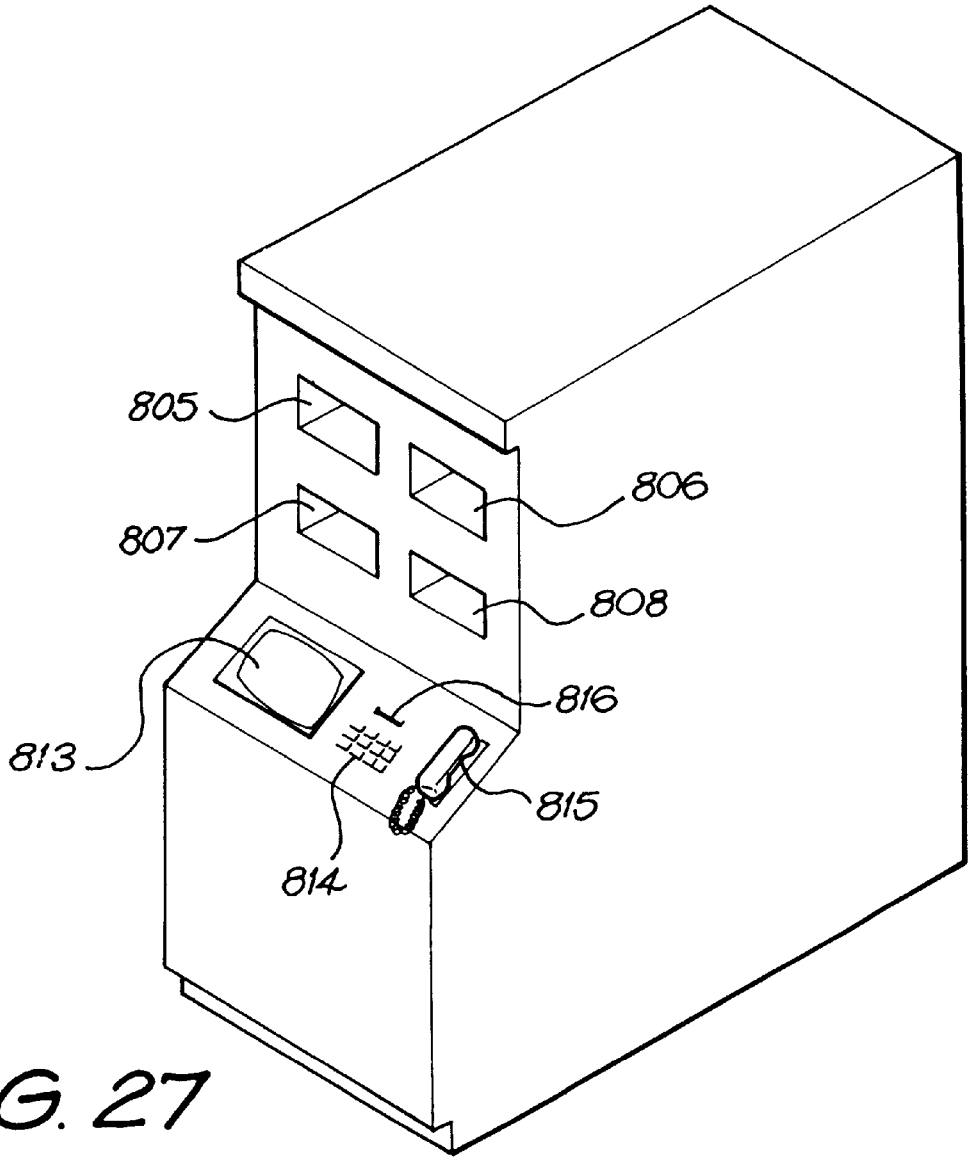
FIG. 27 is a perspective view from above and one side of the embodiment of FIG. 24 with cover in place.

For the cartridge moving details of other slots 806, 805, a moving belt 852 is provided to move the cartridge to frames 820. The moving belt is also under the control of the control means. For dispensing of cartridges, the moving belt 852 would move in the opposite direction and means would be provided to put a cartridge 820 on to the belt 852 from the columns, the means operating together with the lift mechanism 851, 850. FIG. 27 shows the embodiment of FIGS. 24 through 26 with cover 860 in place.

Figure 28:
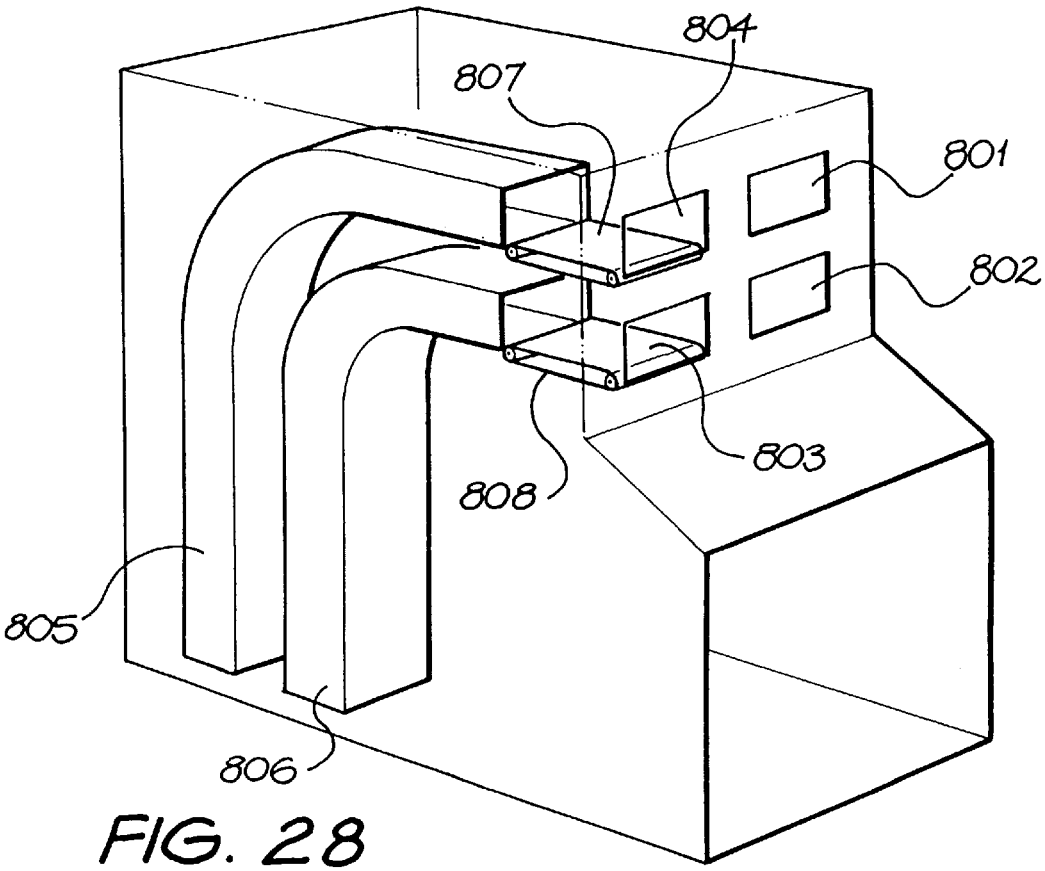
FIG. 28 is a perspective view from above and one side of a further embodiment of the present invention, partially showing internal working details.

FIG. 28 shows a further variation. Four cartridge receiving slots 801 through 804 lead to cartridge receiving stacks 805, 806 (other stacks connected to slots 801, 802 are not shown). Motor driven belts 807, 808 are used to move the cartridges into the stacks 805, 806. This device may be used for storage only. It also has a display panel, keyboard, control means and identification means (not shown) similar to the other embodiments.

Figure 32:
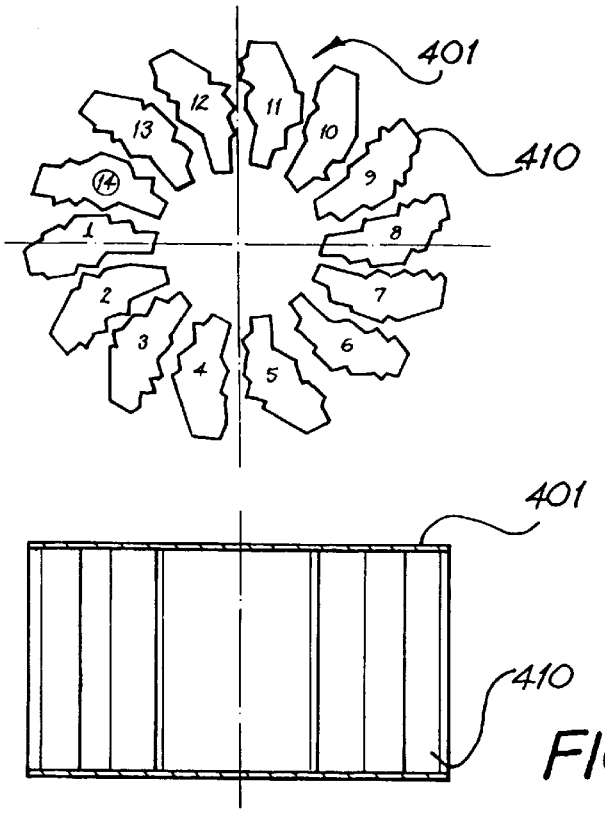
FIG. 32 is a schematic exploded perspective view of an apparatus in accordance with a further embodiment of the present invention, and FIG. 33 are schematic illustrations to show how the apparatus of FIG. 32 stores cartridges.
Figure 33:
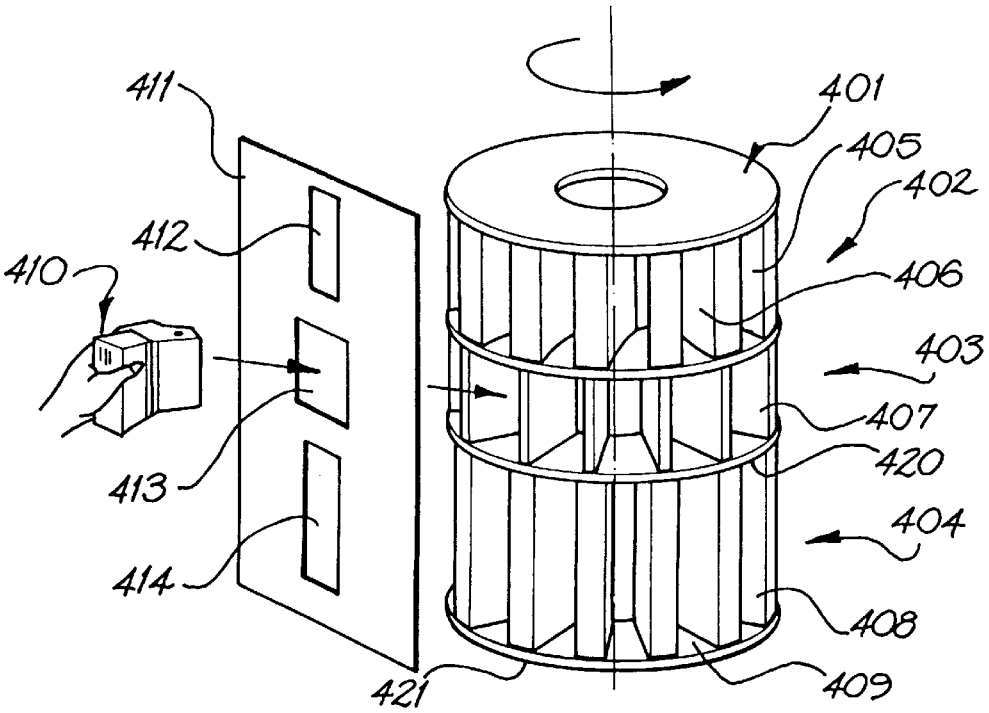

Yet a further embodiment of the present invention is shown in FIGS. 32 and 33. This embodiment shows a storage apparatus 401 in the form of a "carousel". Overall operation is similar to that described in relation to FIGS. 1 and 2 and the apparatus would be associated with control means 600, display panel, keyboard, user identification means or not shown in these drawings. The carousel 401 has a plurality of different levels 402, 403, 404. Each level contains a number of storage spaces which may be the same in each level or which may be for different types of complex article on each level. These slots are designated by reference numerals 405 through 409. As can be seen from the cross-section in FIG. 32A through the carousel 401 showing one level 402 in an entirely loaded state, the best use is made of the available space. The carousel 401 provides a very efficient method of storage. A number of cartridges 410 can be stored. FIG. 32B shows the cross-section looking sideways into the carousel 401.

The apparatus is shown with a front panel 411. In actual implementation, the carousel 401 will be totally enclosed and the only access users will be allowed (not servicing agents) will be via slots 412 through 414 in the front panel 411. The slots 412 to 414 may be of different shapes, depending upon the shape of the article to be placed at a particular carousel 401 level.

In operation, an electric motor (not shown) will revolve the carousel 401 to a desired empty compartment 405 through 409 when a user has indicated by means of the control panel that he wishes to deposit a used article 410. The user then deposits the used article through the entry points 412 to 414 in the front panel 411. Similar shape identification methods may be used as in previous embodiments to accept or reject articles.

Further, should the user require a new article, the carousel 401 will be revolved to allow an entry point 412 to 414 to correspond with a storage compartment containing a new article.

The carousel is provided with moveable covers 420 to 421 which can be moved axially along the outside of the carousel 401 to cover at least two of the levels 402 through 404. Access can therefore be controlled such that a user can see only one slot at a time.

General operation may be in accordance with the overall operation described in relation to FIGS. 1 and 2.

It will be appreciated by persons skilled in the art that numerous variations and/or modifications may be made to the invention as shown in the specific embodiments without departing from the spirit or scope of the invention as broadly described. The present embodiments are, therefore, to be considered in all respects as illustrative and not restrictive.

We claim:

1. A system for monitoring and controlling the storage of used articles and the dispensing of new articles, the system comprising; an apparatus for storing used articles and dispensing new articles, comprising storage space for storing used and new articles, detection means for detecting the storage of a used article, dispensing means for dispensing a new article, and control means for monitoring the storage of used articles and for controlling the dispensing of new articles; and a master control means, the master control means being connected to monitor the operation of the apparatus to determine when the number of used articles has reached a pre-determined number such that the apparatus requires servicing to remove used articles, and to determine when the number of new articles has been reduced to a pre-determined number such that the apparatus requires servicing to be replenished with new articles.

2. A system in accordance with claim 1, the master control means being remote from the apparatus and being connected to the control means of the apparatus by a communications means.

3. A system in accordance with claim 2, comprising a plurality of apparatus for storing used articles and dispensing new articles, connected to the master control apparatus by communication means.

4. A method of recycling complex articles, comprising the steps of providing a system in accordance with claim 1, monitoring the system to determine when the apparatus contains a pre-determined number of used articles, collecting the used articles for recycling, and replacing recycled articles in the apparatus to be dispensed as new articles.

5. A system in accordance with claim 1, the control means of the apparatus being operable to prevent a new article being dispensed if it will result in a pre-determined ratio between new articles that have been dispensed and used articles that have been stored being exceeded.

6. A system in accordance with claim 1, the apparatus further comprising identification means for identifying the user of the apparatus, and memory means for monitoring the number of used articles stored and the number of used articles dispensed for the identified user.

7. A system in accordance with claim 1, the control means being operable to prevent a new article being dispensed if it will result in a pre-determined ratio between new articles that have been dispensed and used articles that have been stored being exceeded, the pre-determined ratio being determined with reference only to used articles stored and new articles dispensed for the identified user.

8. A system in accordance with claim 1, where the detection means includes determining means for assessing pre-determined features of the article to determine whether it is of an approved type to be stored in the storage space.

9. A system in accordance with claim 8, wherein the determining means are arranged to assess features of shape of the article.

10. A system in accordance with claim 9, wherein the determining means comprises a physical receptacle that accurately reflects the physical shape of at least a portion of the article to be stored.

11. A system in accordance with claim 8, wherein the determining means comprises optical sensors.

12. A system in accordance with claim 8, wherein the control means is responsive to the determining means determining that an article is not of an approved type to be stored, to prevent the article from being stored and/or to produce an alarm condition in the apparatus.

13. A system in accordance with claim 1, wherein the control means is responsive to the determining means determining that an article is not of an approved type to be stored, to prevent the subsequent dispensing of a new article.

14. A system in accordance with claim 1, wherein the storage space comprises a plurality of separately accessible storage receptacles, each storage receptacle being arranged to store a used article or new article for dispensing.

15. A system in accordance with claim 14, each storage receptacle being provided with a door controllable by the control means to enable or present access to the storage receptacle by a user.

16. A system in accordance with claim 1, the apparatus being adapted to store and dispense toner cartridges, inkjet cartridges, copier toner cartridges, printer ribbons and the like, as the new and used articles, the used articles being recyclable.

17. In an automated storage and dispensing apparatus, a method of storing used complex articles for recycling and dispensing replacement complex articles, comprising the steps of, on actuation of a control means by a user to indicate that a used article is to be stored, enabling a reception means for receipt of the used article, assessing pre-determined parameters of the used article by sensors and/or mechanical means to determine whether the used article is of an allowable type to be stored, and storing the used article in a storage space if it is of an allowable type to be stored; the further steps of, on actuation of a control means by a user to indicate that the user requires a replacement article, determining the ratio of used articles stored by the user to replacement articles dispensed to the user and, if the ratio does not exceed a pre-determined limit, dispensing a replacement article to the user.

18. A method in accordance with claim 17, the apparatus being adapted to store and dispense toner cartridges, inkjet cartridges, copier toner cartridges and, printer ribbons, as the new and used articles, the used articles being recyclable.

* * * * *